US006912762B2

(12) United States Patent
Lile et al.

(10) Patent No.: US 6,912,762 B2
(45) Date of Patent: Jul. 5, 2005

(54) PALLET DE-BANDING MACHINE WITH IMPROVED ANALYTICAL ABILITIES

(75) Inventors: Richard R. Lile, Spokane, WA (US); Daniel V. Brown, Spokane, WA (US)

(73) Assignee: R. A. Pearson Company, Spokane, WA (US)

( * ) Notice: Subject to any disclaimer, the term of this patent is extended or adjusted under 35 U.S.C. 154(b) by 0 days.

(21) Appl. No.: 10/360,607

(22) Filed: Feb. 7, 2003

(65) Prior Publication Data

US 2004/0154151 A1 Aug. 12, 2004

(51) Int. Cl.[7] ..... B65B 69/00

(52) U.S. Cl. ..... 29/33.52; 29/33.5; 29/707; 29/709; 29/714; 29/407.04; 29/407.1; 29/426.4; 83/909

(58) Field of Search ..... 29/407.1, 33.5, 29/33.52, 707, 709, 714, 407.04, 426.1, 426.4, 566.1; 83/909

(56) References Cited

U.S. PATENT DOCUMENTS

| | | | | | |
|---|---|---|---|---|---|
| 4,095,078 | A | * | 6/1978 | Waenerlund et al. | 219/68 |
| 4,437,223 | A | | 3/1984 | Petros | 29/564.3 |
| 4,773,148 | A | | 9/1988 | Ohya et al. | 29/426.4 |
| 4,835,836 | A | | 6/1989 | van Uitert | 29/564.3 |
| 4,838,751 | A | | 6/1989 | Hanaya et al. | 414/412 |
| 4,841,619 | A | * | 6/1989 | Theriault | 29/426.3 |
| 5,044,937 | A | | 9/1991 | Lisa | 432/5 |
| 5,156,516 | A | | 10/1992 | Boisseau | 414/412 |
| 5,163,216 | A | * | 11/1992 | Ercums et al. | 29/564.3 |
| 6,047,458 | A | * | 4/2000 | Merrill et al. | 29/566.1 |

FOREIGN PATENT DOCUMENTS

| | | |
|---|---|---|
| DE | EP 976657 | 6/1999 |
| EP | 1072519 | 7/2000 |
| JP | 9-267816 | 9/1997 |

OTHER PUBLICATIONS

PTO English Translation of EP 0 976 657.*
EP 0 976 657 Derwent English Abstract.*

* cited by examiner

*Primary Examiner*—Eric Compton
(74) *Attorney, Agent, or Firm*—Wells St. John P.S.

(57) ABSTRACT

An automated de-banding machine which can perform by scanning the surface of the pallet to determine the number and position of bands to be removed. The machine also is capable of analyzing to determine the overlay bands from underlay bands. The overlay bands are removed first and typically fed individually to a chopper which chops the bands into pieces for recycling. The band information may be recorded and used to facilitate handling of a similar type of pallet in future operations to eliminate any stoppage for determination of retooling or adjustment.

47 Claims, 38 Drawing Sheets

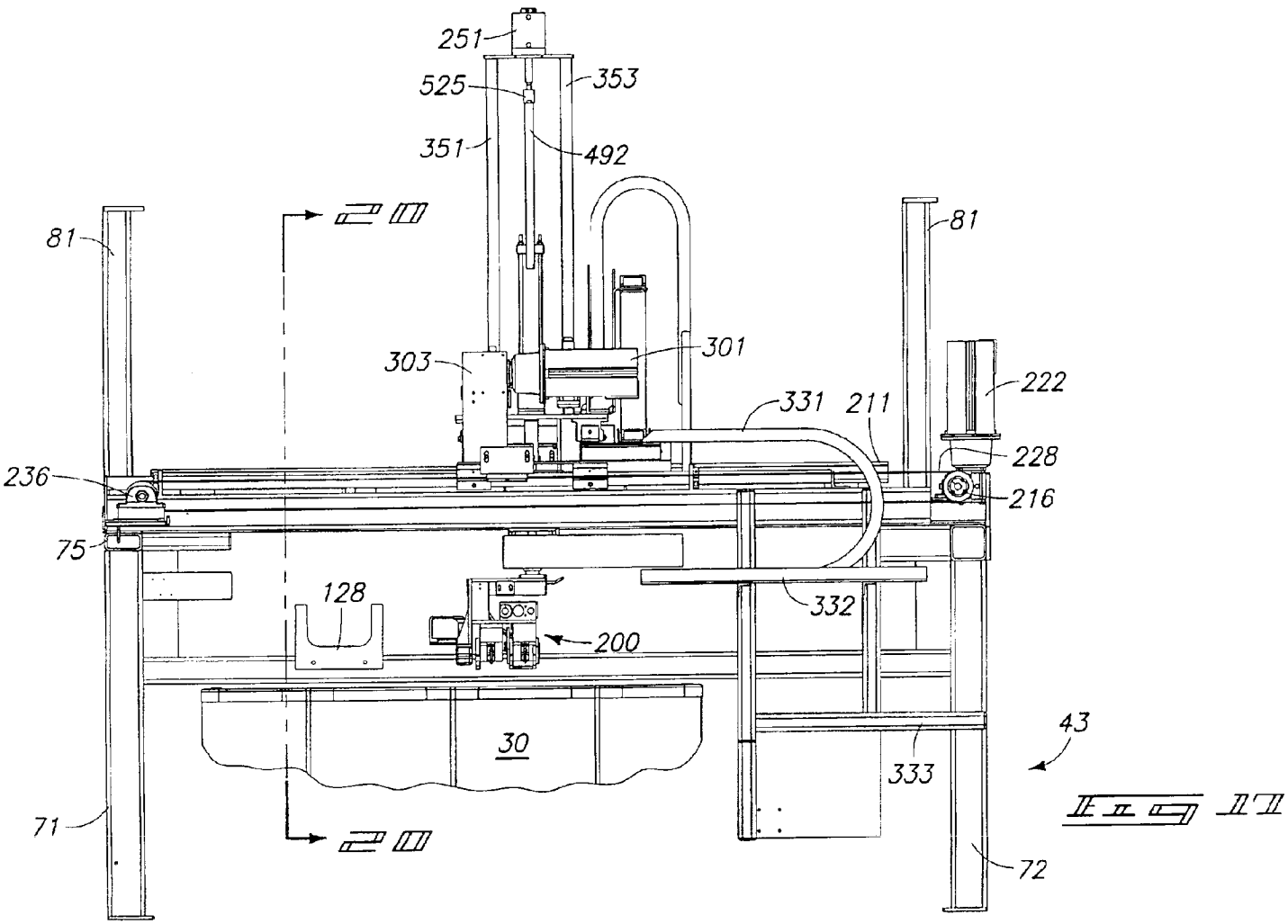
43
222
228
216
72
81
333
211
332
331
301
353
492
200
30
251
525
351
303
128
81
236
75
71

500
510
511
512
513
514
519
520
529
530
532
533
534
535
536
540
550
551
560
581
582
583
584
585
586

PALLET DE-BANDING MACHINE WITH IMPROVED ANALYTICAL ABILITIES

TECHNICAL FIELD

The invention relates to machines and processes used to automatically cut, remove and dispose of bands used to secure goods upon shipping pallets.

BACKGROUND OF THE INVENTION

The packaging industry commonly uses pallets which have goods stacked thereon which are secured in position by a plurality of pallet bands. These bands vary in number and position depending upon the type of goods and techniques used to create and band the pallets. In the past it has been typical that pallets from one location or facility are different from those made up at another facility. This has made the removal of the pallet bands by the user more difficult.

Some prior machines have been developed for automated de-banding (hereinafter "debanding") of pallets. These machines have previously used a movable cutter head which moves over or along the pallets and cuts the bands. These prior machines have suffered from a number of problems.

One significant problem arises because the pallet bands may not be in the same positions from pallet to pallet. Most prior debanding machines use pre-programmed band positions to control the machine. When a pallet arrives that does not have the bands positioned as pre-programmed, then the machine may malfunction and human operator intervention will be required.

When the pallets are from the same or a similar source the banding positions may be variable but typically workable on an automated basis. However, when they are from different sources then the variations may be problematic enough that operations are hampered or prevented. In some situations the variations in the pallet band patterns generated by the same machinery are sufficiently problematic to be unworkable. In the past substantial operational assistance has been needed to keep debanding machines operational due to band positioning variations.

Another notable problem has been the difficulty arising if the overlay and underlay relationship of the bands changes for any reason. The overlay and underlay relationships between the various bands used on a pallet are important during removal because the bands may become entangled if not removed in the proper order. Although pallets may have bands which are in a similar positional relationship and have similar numbers of total bands, they may be shipped with varying overlay and underlay relationships between the longitudinal bands as compared to the transverse bands. Prior machines necessarily assume that the overlay/underlay relationship of the bands was the same for all pallets using the pre-programmed settings. Such pre-programmed setups required substantial amounts of time. Additionally, it may be that pallets from the same facility having the same type and band patterns may not have the same overlay/underlay relationships from one pallet to another. This necessarily causes substantial problems in automated processing of the pallets to deband the pallet for subsequent depalletization.

One prior approach to solving the underlay/overlay problem has instead used a system which cuts all bands simultaneously. This approach is may solve the underlay/overlay problem, but again is highly susceptible to any variations in the band pattern. If a different type of pallet is being processed, then substantial setup time and costs are needed to address the changed conditions.

These and other problems have not been fully and adequately addressed by the prior debanding machines. Other problems and considerations may become evident in the future as this invention is used more or further develops.

BRIEF DESCRIPTION OF THE DRAWINGS

Preferred embodiments of the invention are described below with reference to the following accompanying drawings.

FIG. 4 is an enlarged view showing a portion of the machine of FIG. 1.

FIG. 7 is a further detailed perspective view showing another portion of the embodiment of FIG. 1.

FIG. 13 is a perspective view showing a portion of the frame and movable head operating assemblies used in the embodiment of FIG. 1.

FIG. 15 is a rear elevational view of the subassembly shown in FIG. 13.

FIG. 16 is a left side elevational view of the subassembly of FIG. 13.

FIG. 17 is a front elevational view of the subassembly of FIG. 13.

FIG. 18 is a sectional view taken along line 18—18 of FIG. 16.

FIG. 34 is a side view of the subassembly of FIG. 31.

FIG. 35 is a side view opposite from that shown in FIG. 34 of the subassembly of FIG. 31.

FIG. 37 is an end view opposite to that of FIG. 36 of the subassembly shown in FIG. 31.

DETAILED DESCRIPTION OF THE PREFERRED EMBODIMENTS

Introductory Note

The readers of this document should understand that the embodiments described herein may rely on terminology used in any section of this document and other terms readily apparent from the drawings and language common therefor. This document is premised upon using one or more terms with one embodiment that will in general apply to other embodiments for similar structures, functions, features and aspects of the invention. Wording used in the claims is also descriptive of the invention. Terminology used with one, some or all embodiments may be used for describing and defining the technology and exclusive rights associated herewith.

Figure 1:
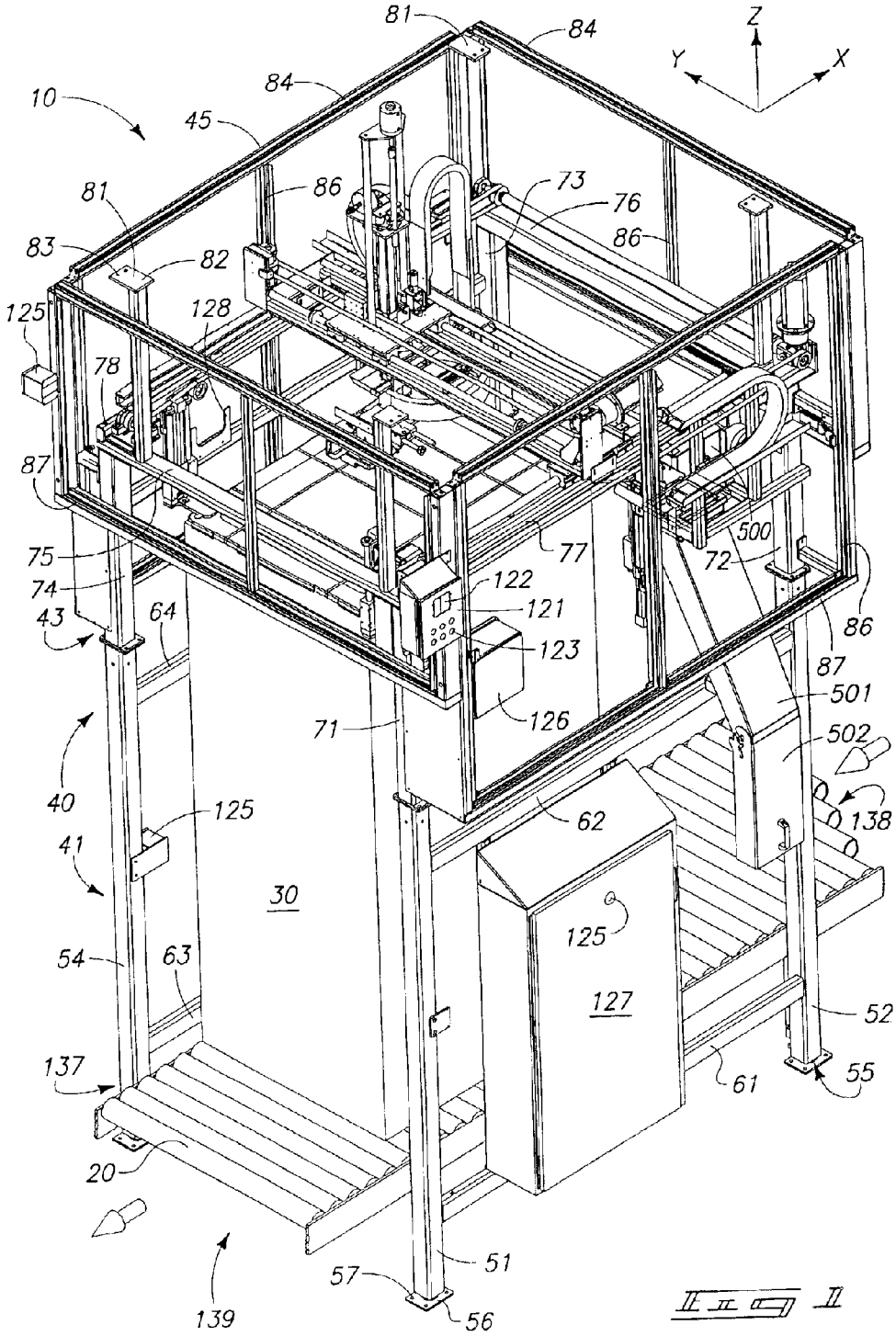
FIG. 1 is a perspective view showing a preferred debanding machine according to the invention.

Debander of FIG. 1 Generally

FIG. 1 is a perspective view showing a preferred embodiment of debanding machine 10 according to this invention. Debanding machine 10 is preferably used in conjunction with conveyor 20. Conveyor 20 is not a part of the invention but instead supplied by the facility at which debanding of pallets is to take place. Conveyor 20 may be constructed according to a variety of different designs. The size of the debander must be sufficient to allow use with a particular conveyor.

As shown, conveyor 20 is a power driven, roller conveyor which moves the pallets from the right side as shown in FIG. 1 towards the left side. Pallet movement into and away from the machine preferably occurs along the X-axis as indicated in the accompanying legend shown in FIG. 1.

FIG. 1 also shows a pallet 30 positioned within the debanding machine. The pallet is positioned at a receiver or receiving station which is advantageously within the framework of the machine as is explained next.

Frame

The debanding machine includes a frame or framework 40 which has a lower or base portion 41 and an upper or superstructure portion 43. Framework 40 also includes a protective enclosure frame 45 which is connected to the upper framework 43. The protective enclosure frame 45 is used to support safety panels (not shown) which are mounted about the upper portion of the machine to restrict access to the movable components of the debanding machine during operation. There are also additional frame parts that may be used to support various individual or subassemblies of the machine that are apparent from the drawings and/or described hereinafter. Specific description of some of the components of the various frame sections will now be considered in greater detail.

The frame base portion or lower frame 41 advantageously includes support posts, such as the four base corner posts 51–54. It is alternatively, possible to use three support posts to facilitate easy cleaning around the machine. Suitable modifications to the frame would be needed to accomplish this, but it is an alternative. It should also be appreciated that a variety of frame configurations are possible and may be needed to meet particular installation requirements.

The lower frame corner posts are advantageously provided with feet 55. Feet 55 preferably have footplates 56 through which apertures 57 may be provided in order to place mounting fasteners (not shown). The mounting fasteners may be extended into a concrete slab or other supporting structure upon which the debanding machine 10 is mounted. The debanding machine is preferably securely affixed to the supporting building structure to prevent movement of the machine during operation.

The lower framework 41 also preferably includes front lower member 61 and front upper member 62 which are both shown horizontal and extend between the front left and right corner posts 51 and 52. Similarly, the rear of the debanding machine is provided with a lower horizontal frame member 63 and upper horizontal frame member 64, both of which extend between the rear corner posts 53 and 54 (corner post 53 not shown in FIG. 1).

The lower framework 41 may further be provided with temporary frame struts (not shown) which extend between the front and back corner posts for use during shipping and setup of the machine but which are removed during operation. These stabilize the machine until such time as the footplates are secured to the supporting floor.

As indicated above the frame includes an upper framework which is connected to the lower frame 41. The upper framework includes four corner posts 71–74 which preferably are adapted to detachably fasten to the upper ends of the lower framework corner posts 51–54 using complimentary mounting flanges and suitable fasteners.

The upper ends of the upper framework corner posts 71–74 are preferably connected by front-to-back upper framework transverse members 75 and 76 which extend between the corner posts and are affixed thereto. Upper frame longitudinal members 77 and 78 extend between the left and right upper corner posts 71 and 72, and 73 and 74, respectively.

The above principle members of the upper framework provide the basic structural frame for the upper frame subassembly. In addition to the primary upper frame structural members, there are additional framework members associated with the safety enclosure frame 45. Safety enclosure frame 45 can advantageously include top panel support posts 81 which extend upwardly and have mounting plates 82 at the upper ends thereof for resting a top horizontal safety panel thereon. Support plates 82 can include fastener holes 83 for securing the safety panel in position thereon.

Safety framework 45 also preferably includes upper perimeter members 84 which extend about all four sides along the upper portion of the safety framework. Additionally, the safety framework includes vertical safety framework pieces 86 at a number of positions about the machine which are used to provide additional support for the preferred transparent safety panels being supported thereby. The lower edges of the safety panels are supported by lower horizontal safety frame members 87 which extend also along all four sides of the safety framework 45, which are at different elevations over the entrance and exit portals to the pallet receiver.

Pallet Receiver

Framework 40 preferably includes a pallet receiving space 137 which is accessible through portals 138 and 139 defined between the front and rear corner posts 51 and 54 and 52 and 53 for the left and right ends of the debanding machine as shown in FIG. 1, respectively. The entrance and exit portals allow entrance and egress of the pallet 30 into and from the receiver formed within the framework and below the transverse frame pieces 75 and 76. Where the safety enclosure frame is included, the portals are possibly further restricted in height, such as illustrated in the Figs.

Pallets

Figure 2:
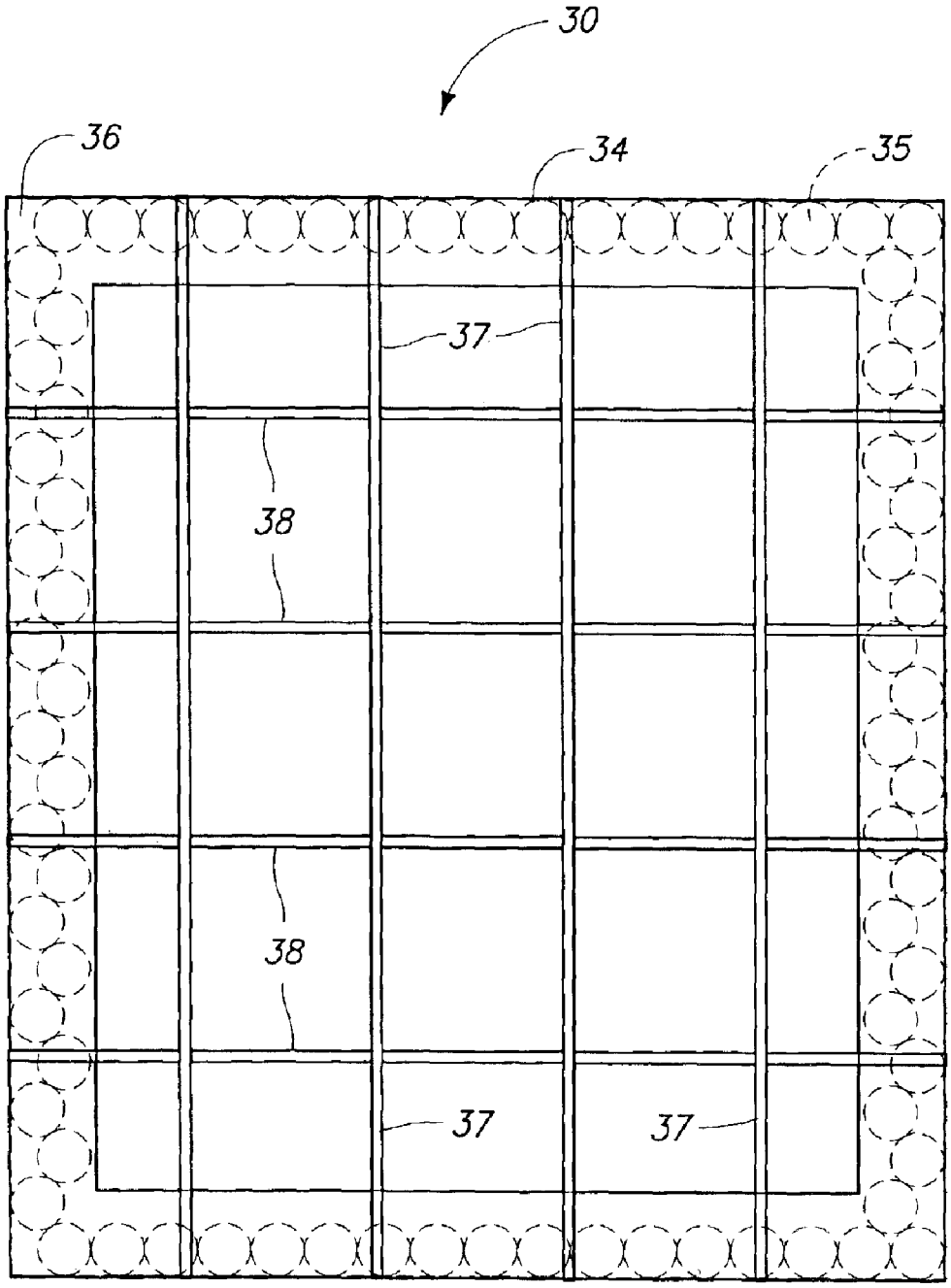
FIG. 2 is a top diagram view showing one possible pallet configuration having bands extending over the top of the pallet.
Figure 3:
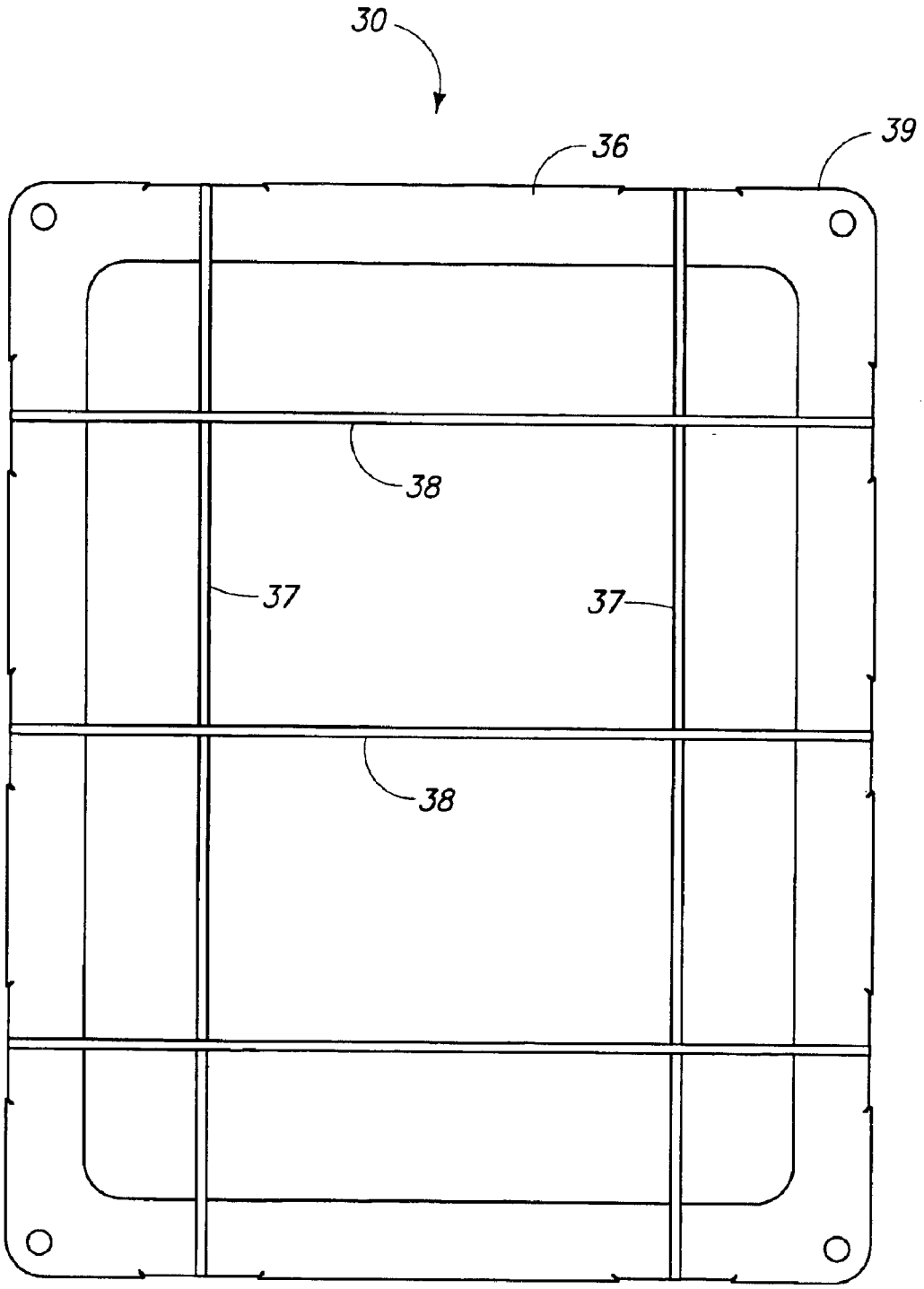
FIG. 3 is a top view of another pallet configuration wherein there is a band pattern which is used to secure a top frame just below the bands.
Figure 11:
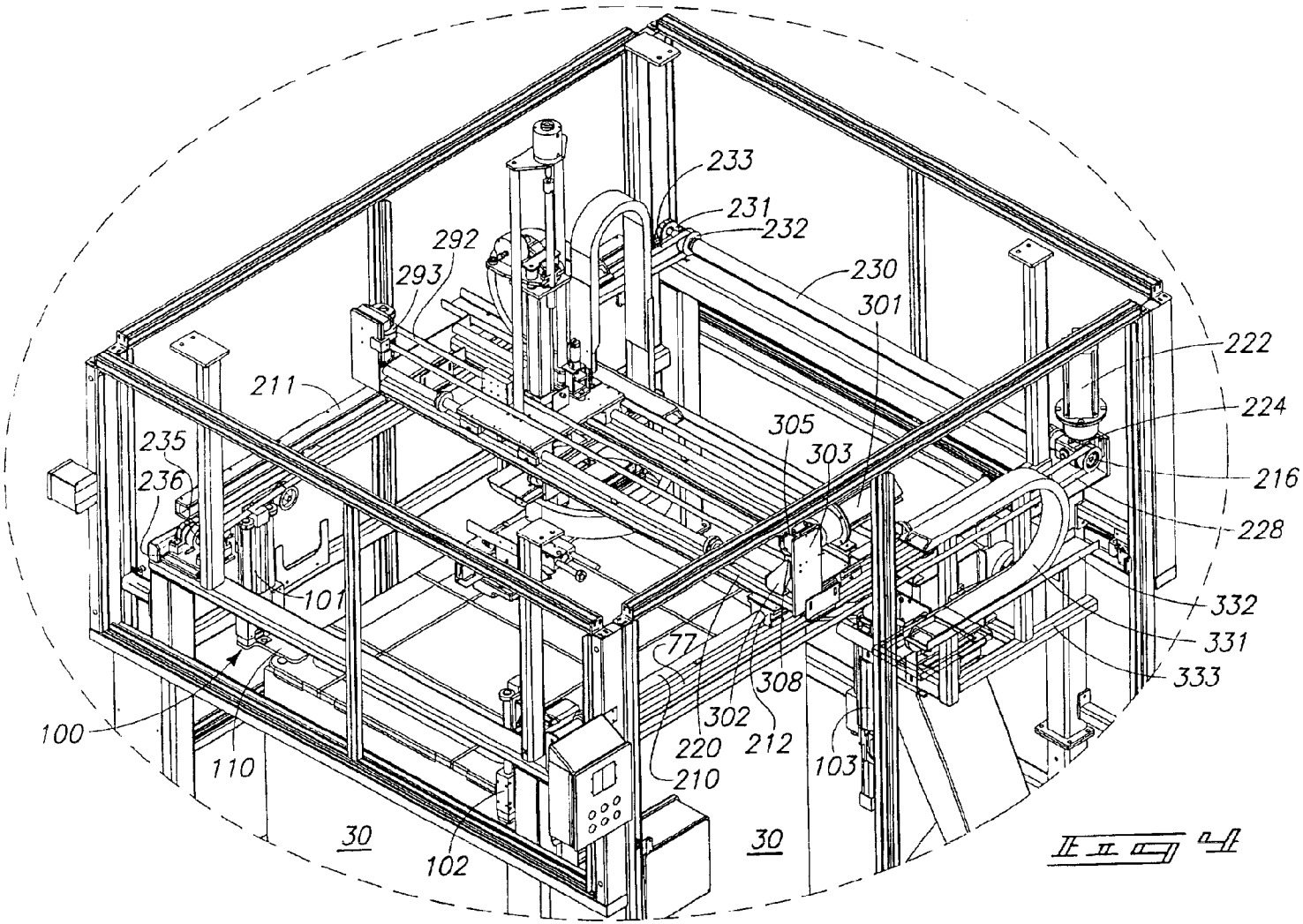
FIG. 11 is a rear elevational view of the embodiment of FIG. 8.

FIGS. 2 and 3 show two different exemplary pallets with associated pallet band configurations. FIG. 2 is a top view of a pallet 34 having empty beverage containers 35 held in several layers. The layers are divided by layer partitions (not shown). FIG. 2 also shows an optional but exemplary top frame 36 which is superimposed upon the beverage containers. The top frame is restrained by longitudinal pallet bands 37 which run the long direction of the pallet. The top frame is also secured by transverse or cross bands 38 which run transversely across the pallet in the shorter dimension or width of the pallet. The bands typically will run in a complete loop around both the top frame, pallet contents and pallet bottom frame (not specifically illustrated in FIG. 2).

In the pallet band configuration of FIG. 2 the transverse and longitudinal bands cross or intersect at a band junction. As shown, the longitudinal bands 37 overlay the transverse bands which underlay. This may be referred to as a longitudinal band overlay configuration.

FIG. 3 shows a different pallet 39 which has similar features as pallet 34 and the same numbers are used for the same features. Pallet 34 of FIG. 2 has four (4) bands in both the transverse and longitudinal directions. Pallet 39 has only two (2) longitudinal bands 37 and three (3) transverse bands 38 except the transverse bands 38 are the overlay bands and the longitudinal bands 37 are the underlay bands. Thus the band configuration of FIG. 3 may be referred to as a transverse overlay band configuration.

Although not typical, it is also possible to have band crossings which have different overlay/underlay relationships on the same pallet. This configuration is not specifically illustrated but is readily apparent from FIGS. 2 and 3. Such may be referred to as a mixed overlay/underlay band configuration.

Pallet Hold-Down Clamps

Figure 9:
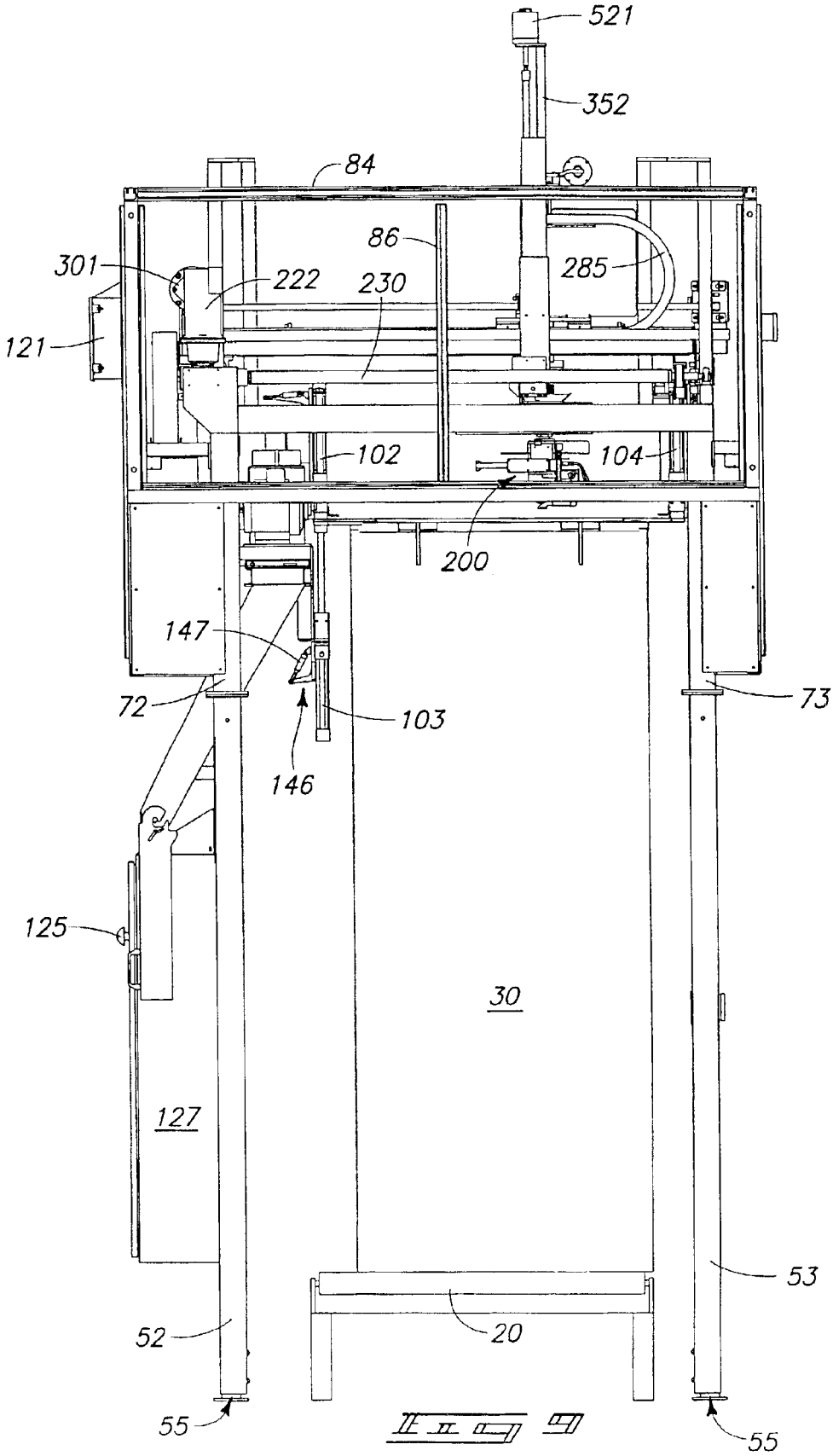
FIG. 9 is a right side elevational view of the embodiment of FIG. 8.
Figure 10:
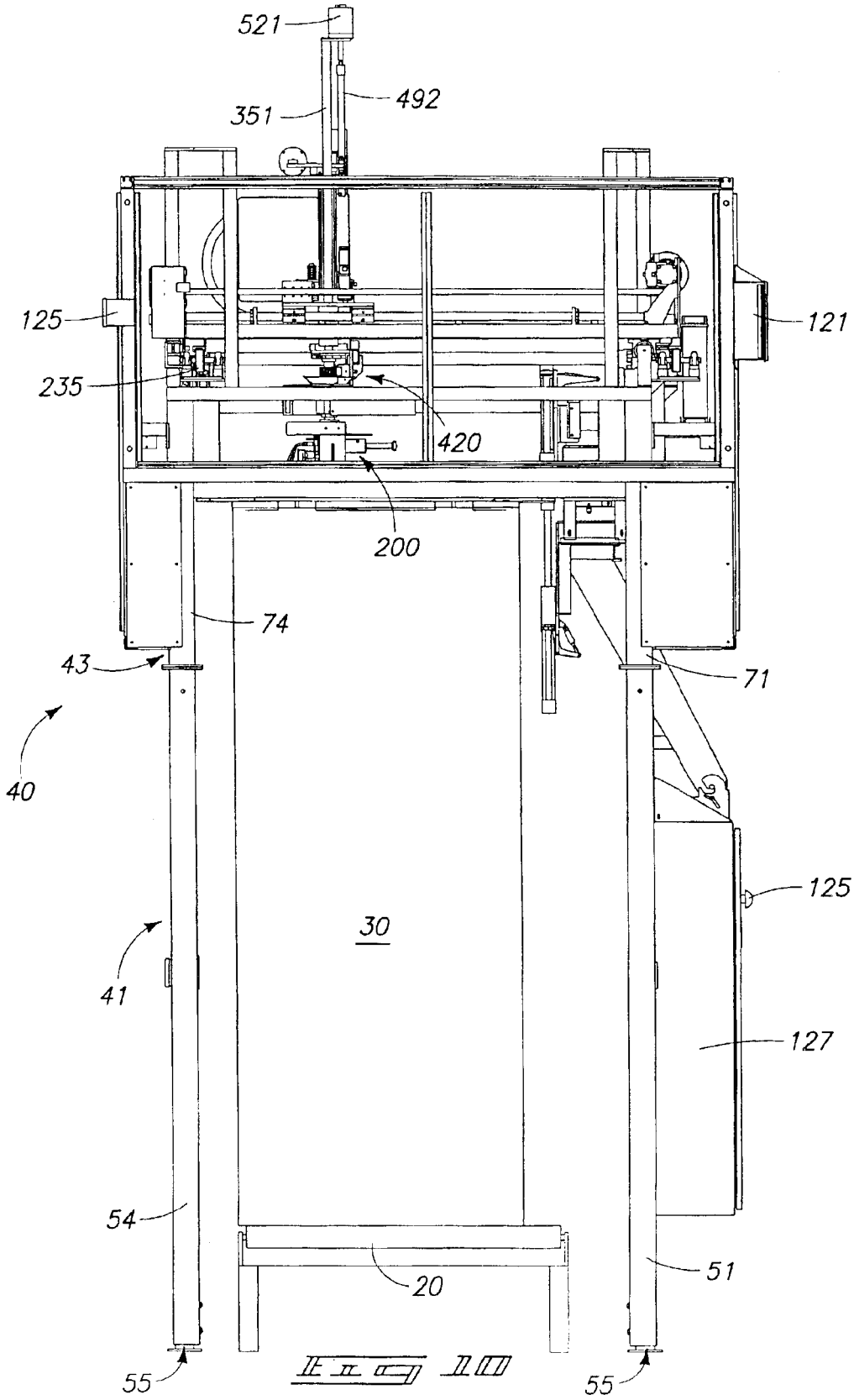
FIG. 10 is a left side elevational view of the embodiment of FIG. 8.
Figure 11:
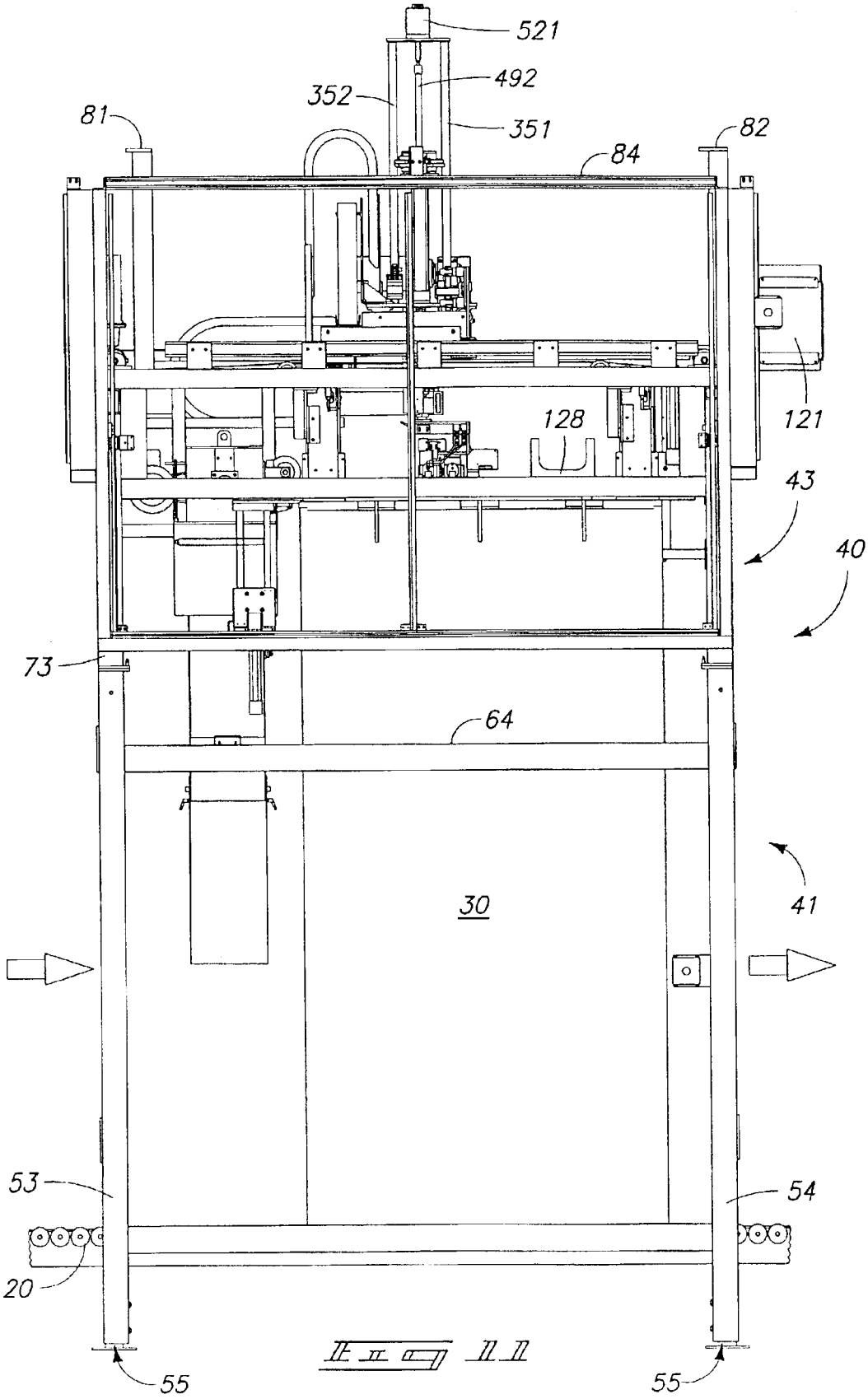
Figure 12:
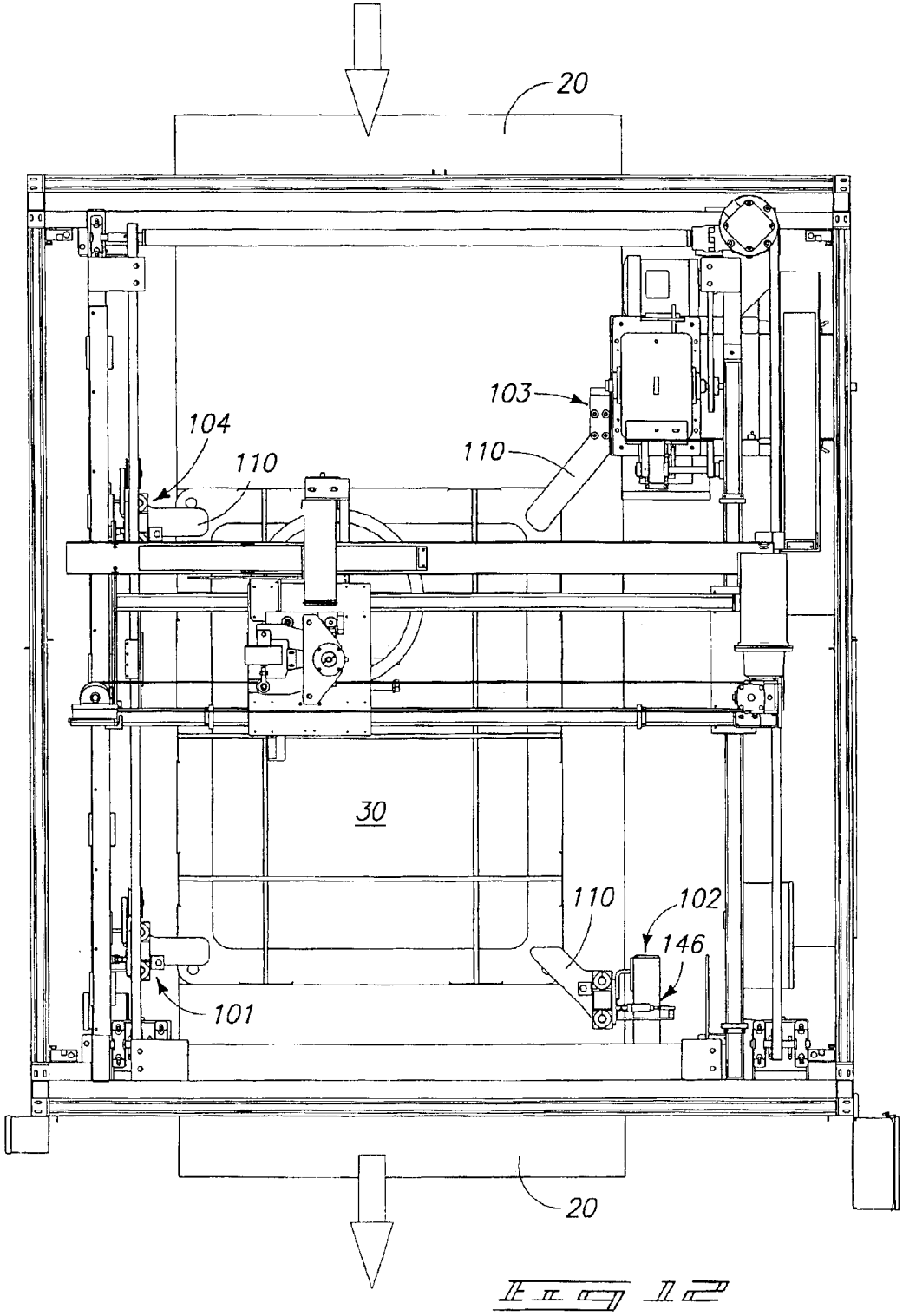
FIG. 12 is a top view of the embodiment of FIG. 8.
Figure 11:
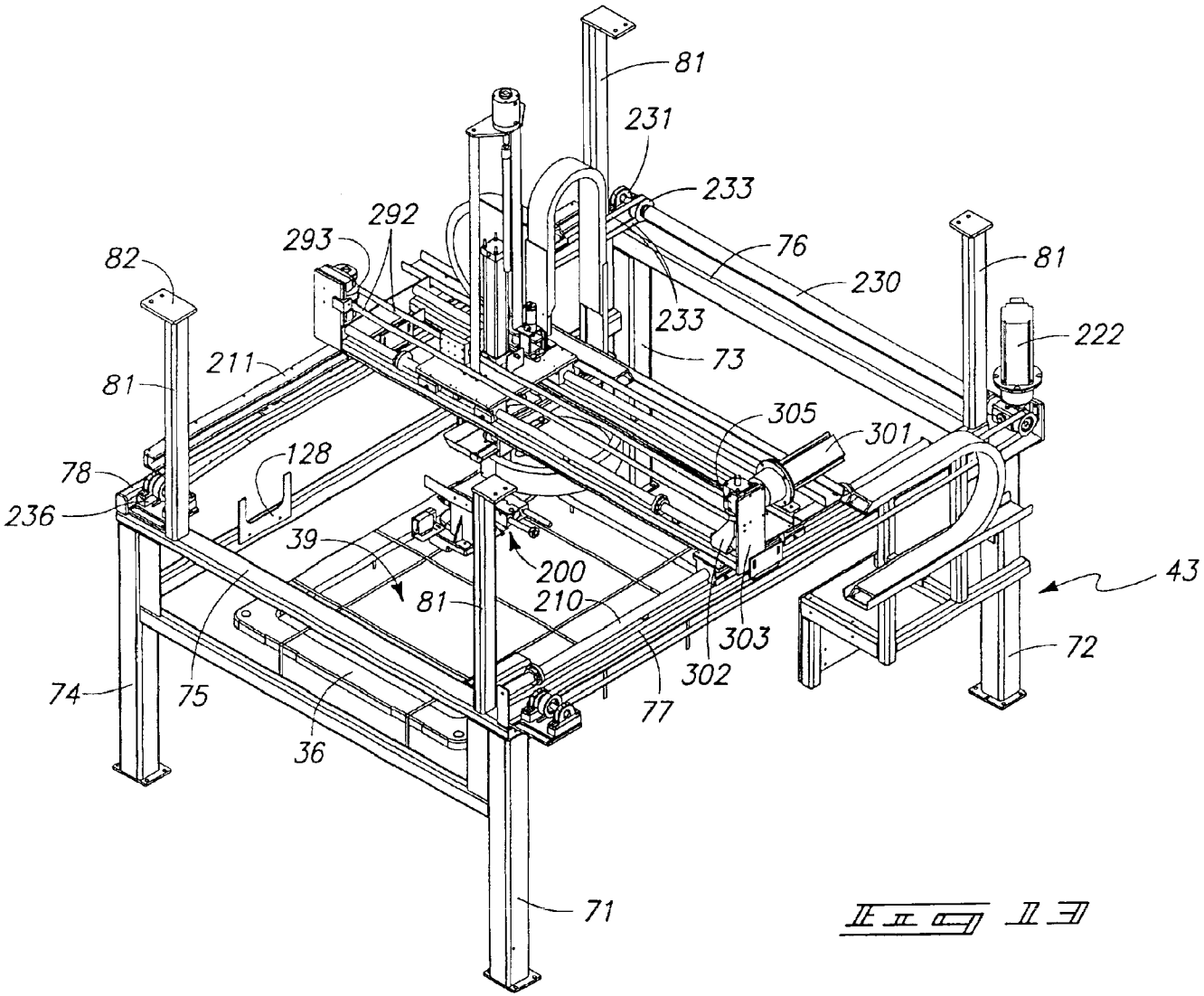
Figure 14:
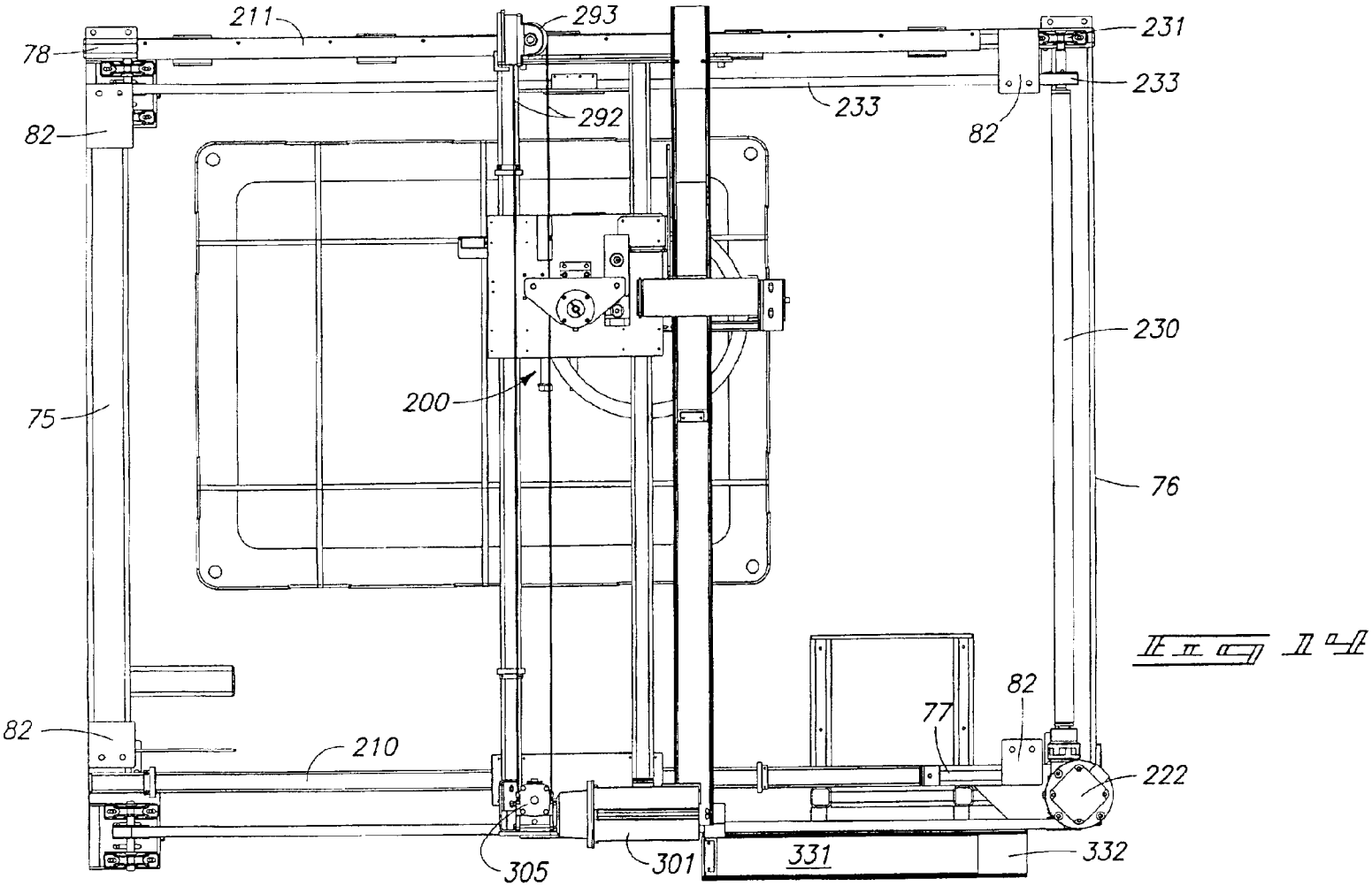
FIG. 14 is a top view of the subassembly shown in FIG. 13.
Figure 11:
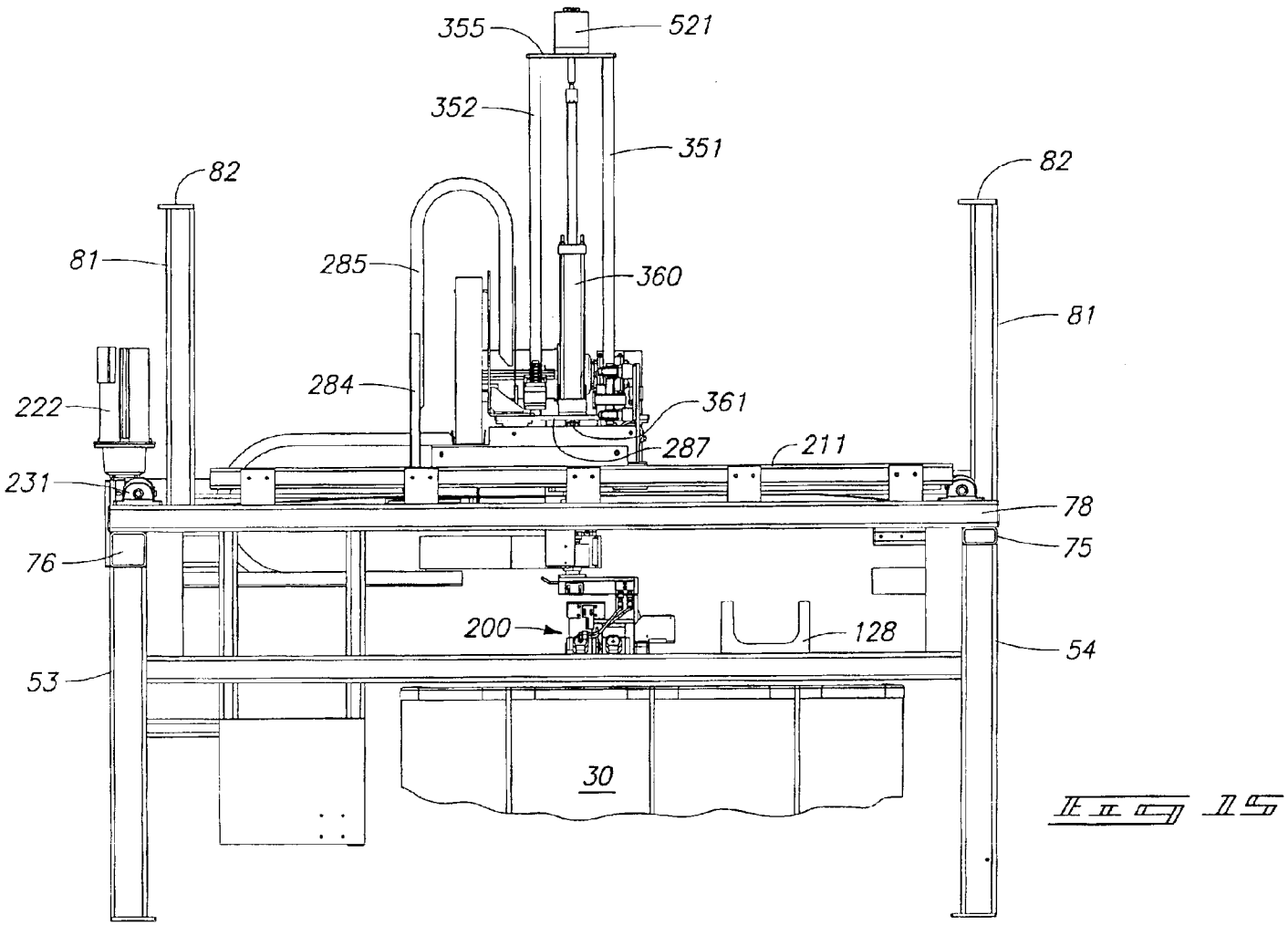
Figure 11:
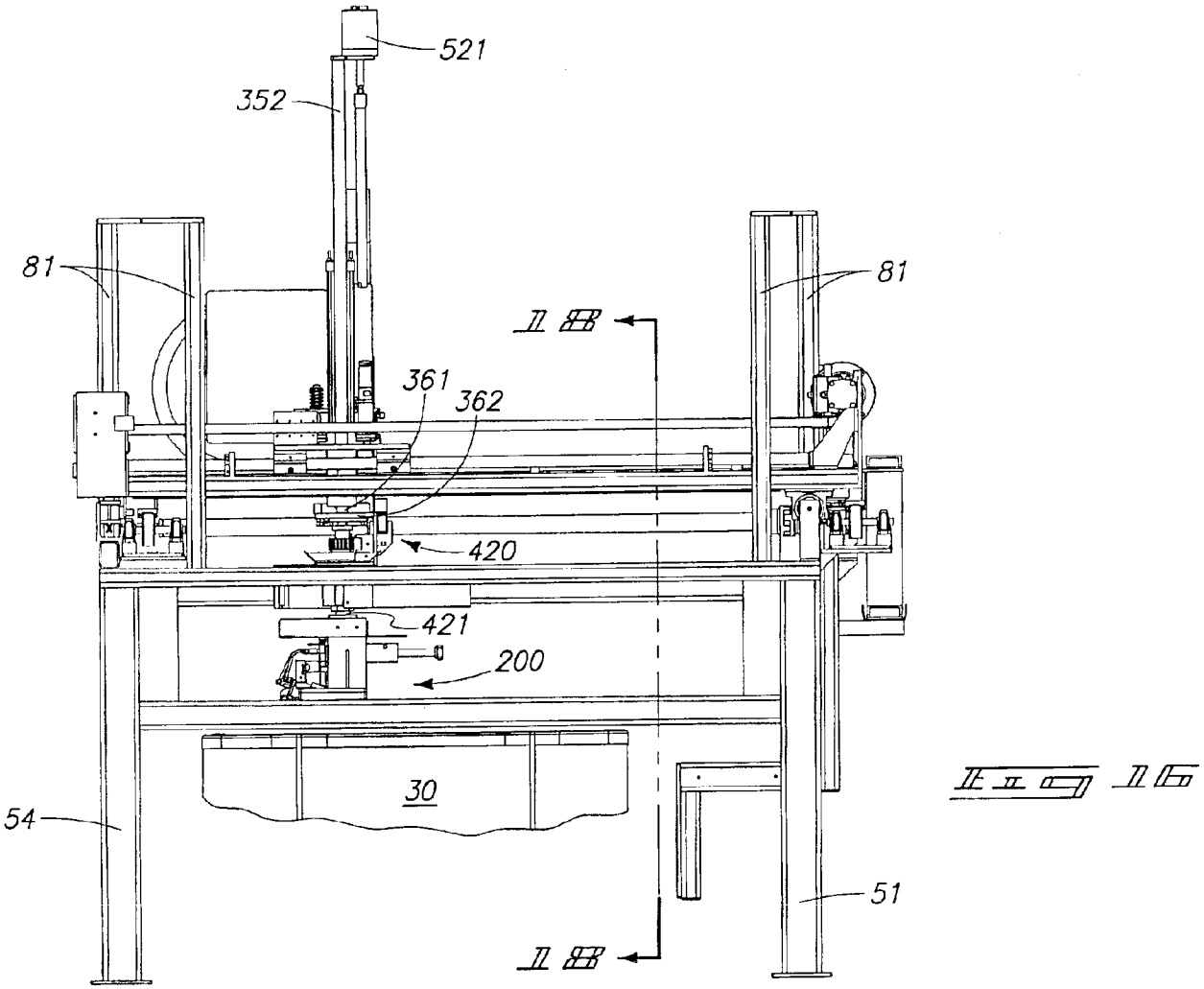
Figure 11B:
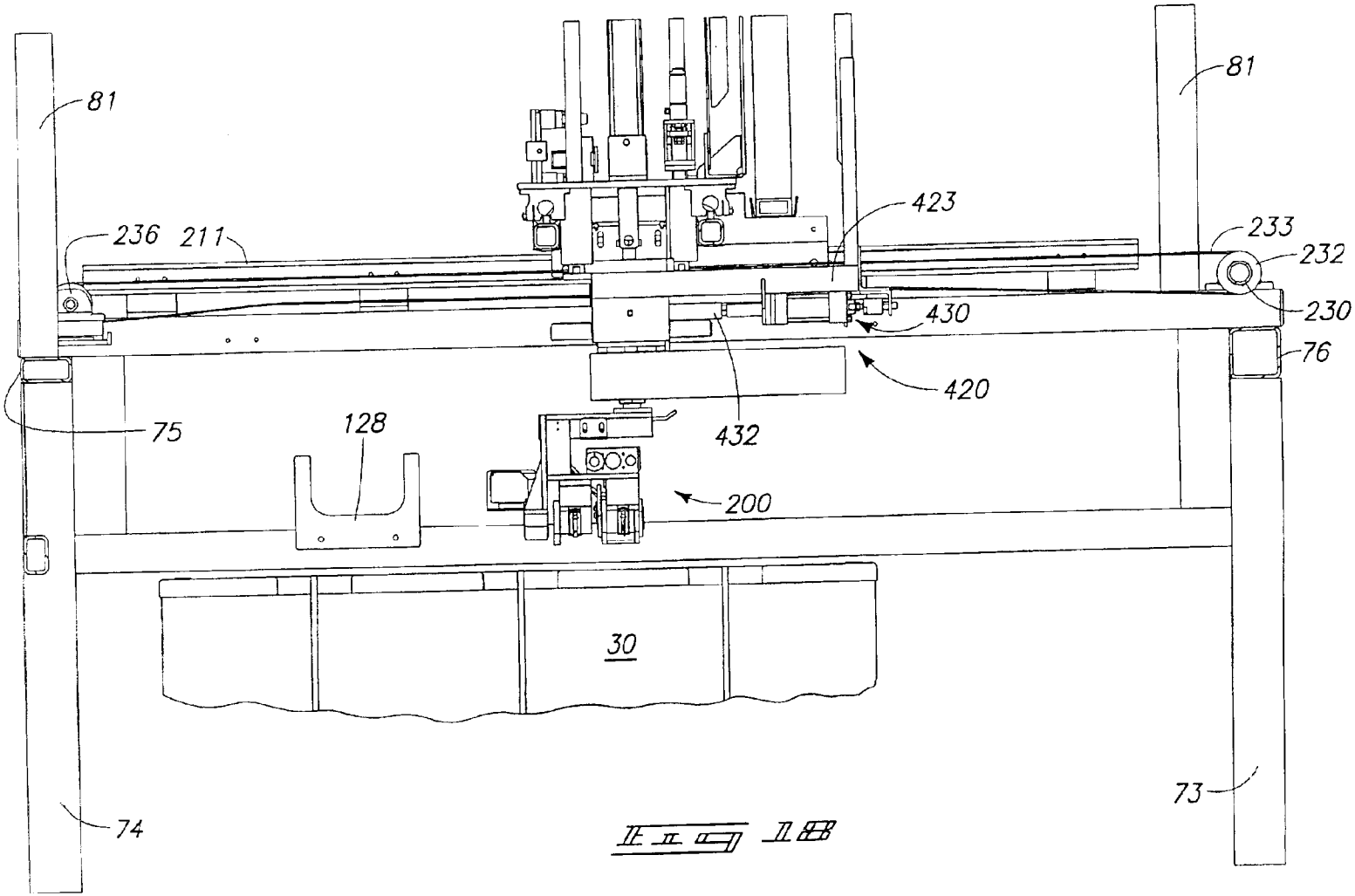
Figure 19:
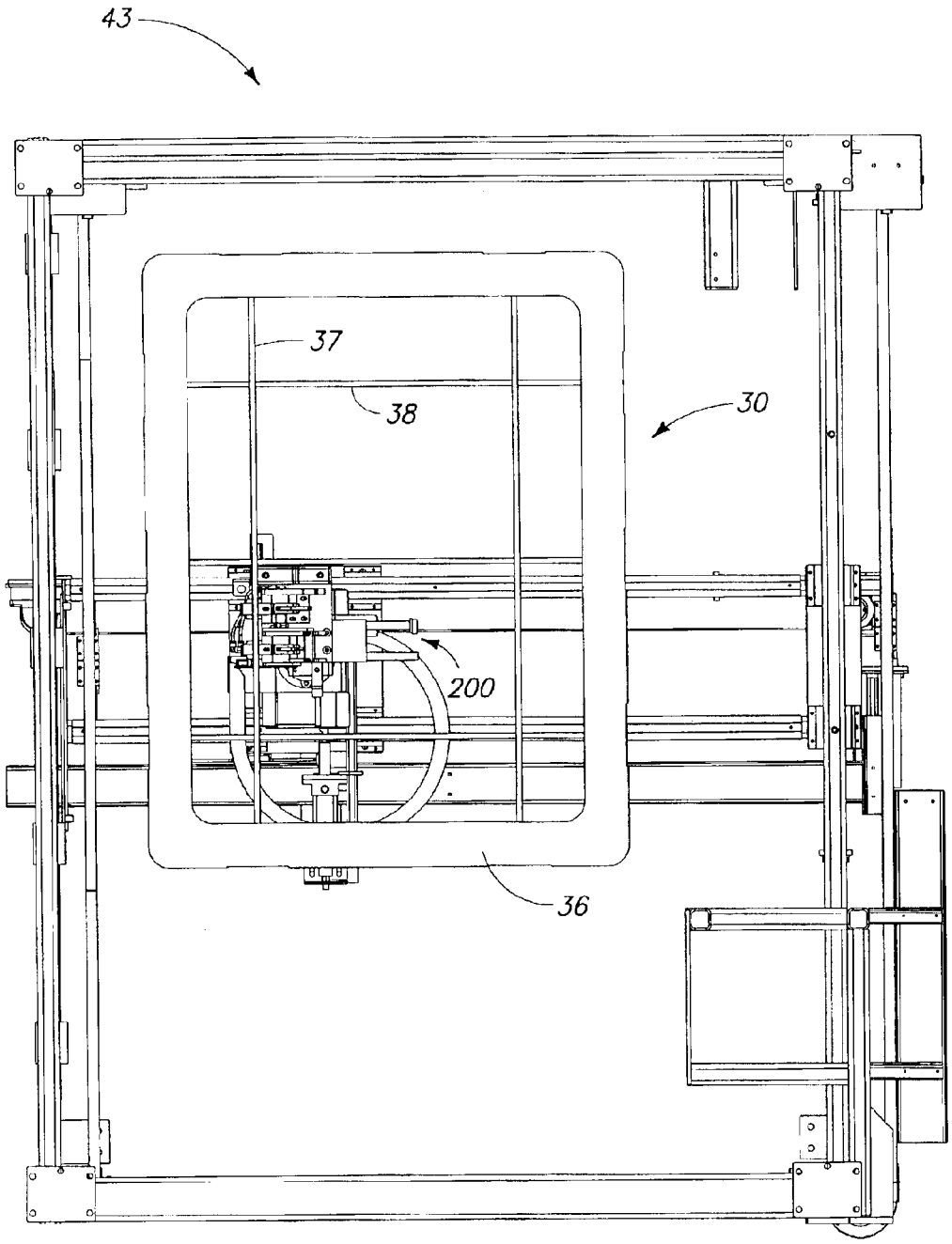
FIG. 19 is a bottom view of the subassembly of FIG. 13.

FIG. 4 shows the upper portions of the debanding machine of FIG. 1 in greater detail. In particular, FIG. 4 shows that the debanding machine preferably includes one or more pallet hold-down mechanisms or other pallet clamps or securing devices 100 which secure the pallet in a working position within the pallet receiver. As shown, the pallet clamp or other securement mechanism or mechanisms 100 includes four pallet hold-downs 101—104. Hold-down 104 is not shown in FIG. 4 but is shown in FIG. 9.

Figure 6:
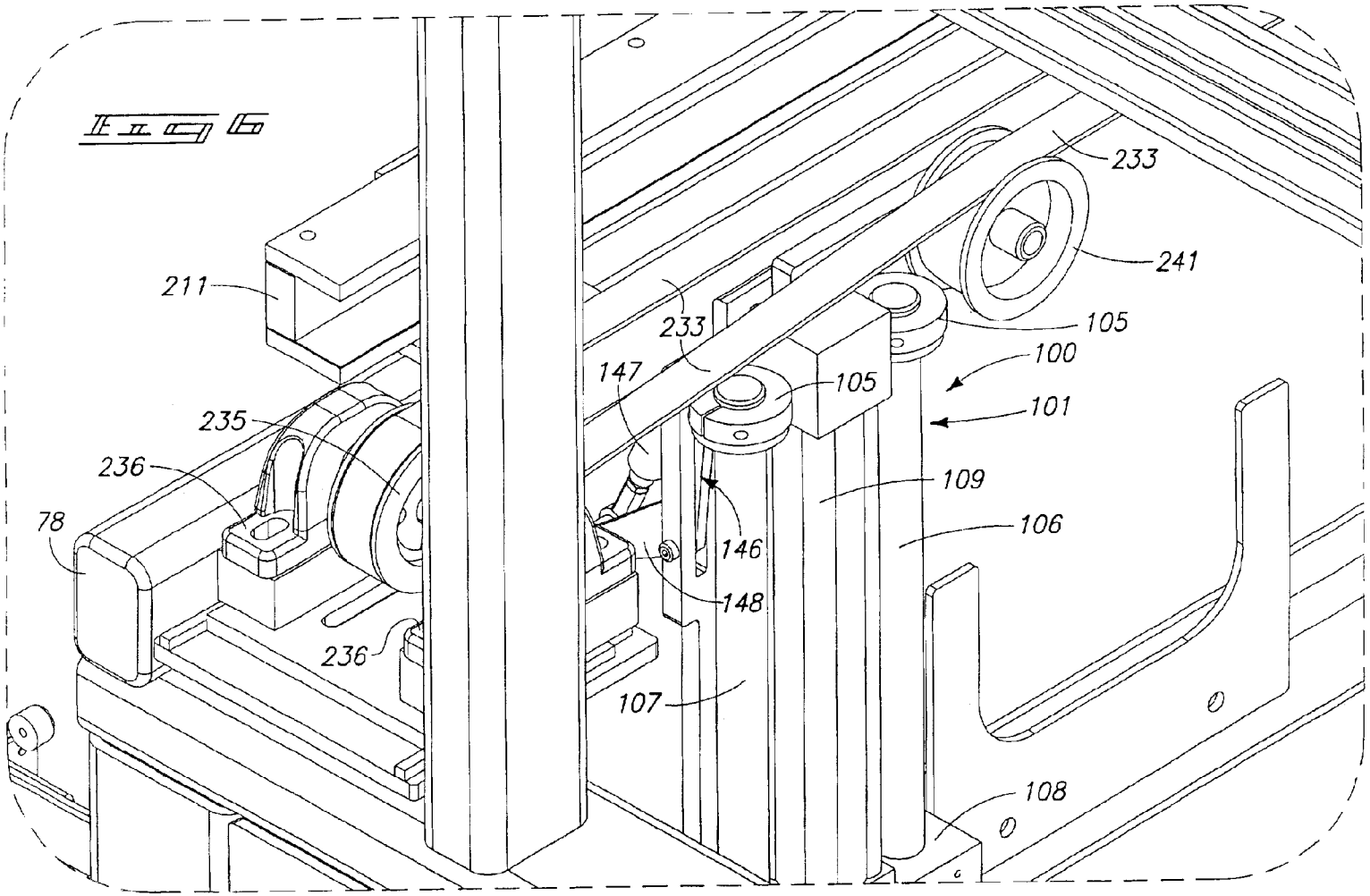
FIG. 6 is a further detailed perspective view showing another portion of the embodiment of FIG. 1.
Figure 11:
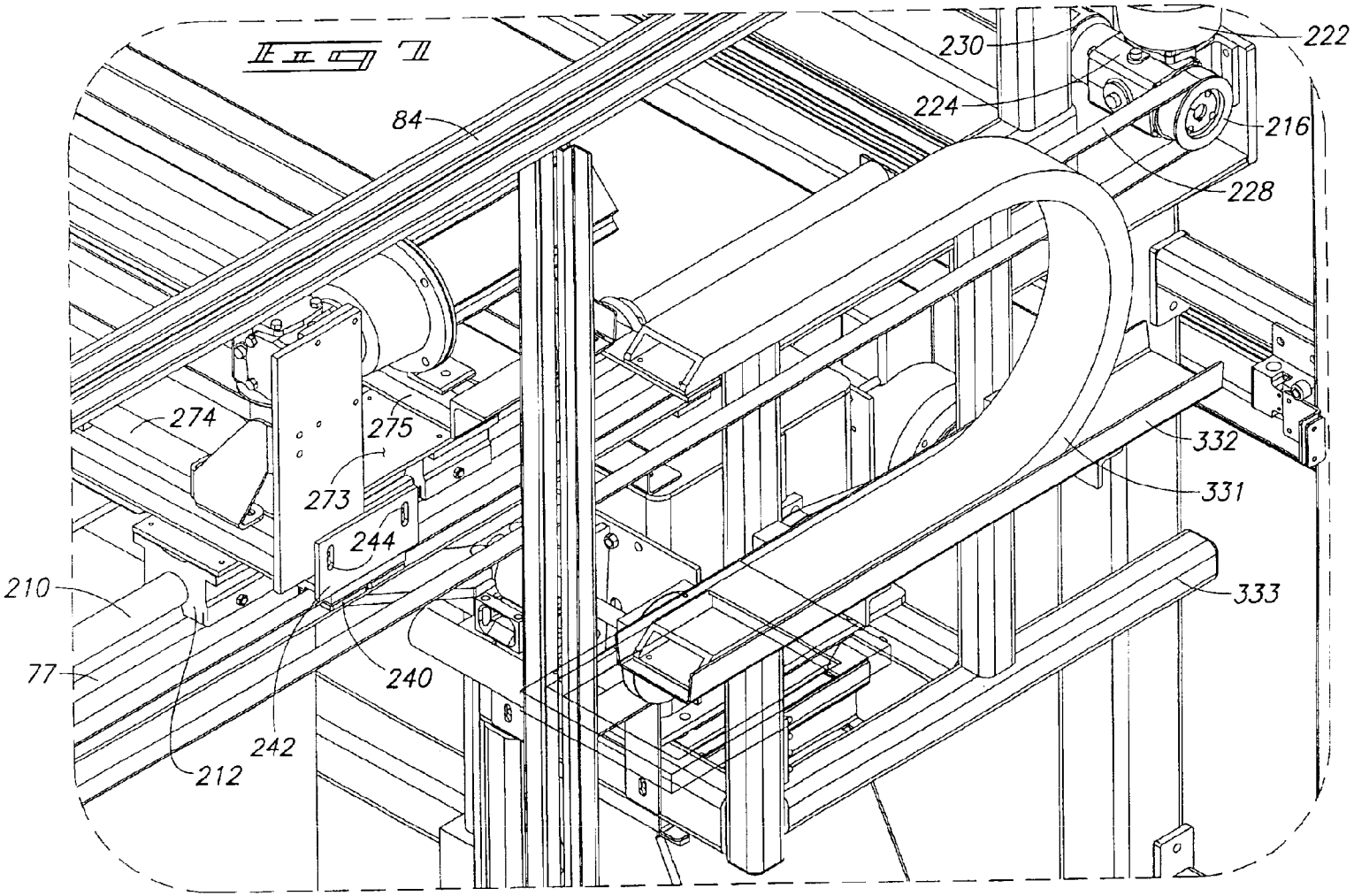
Figure 8B:
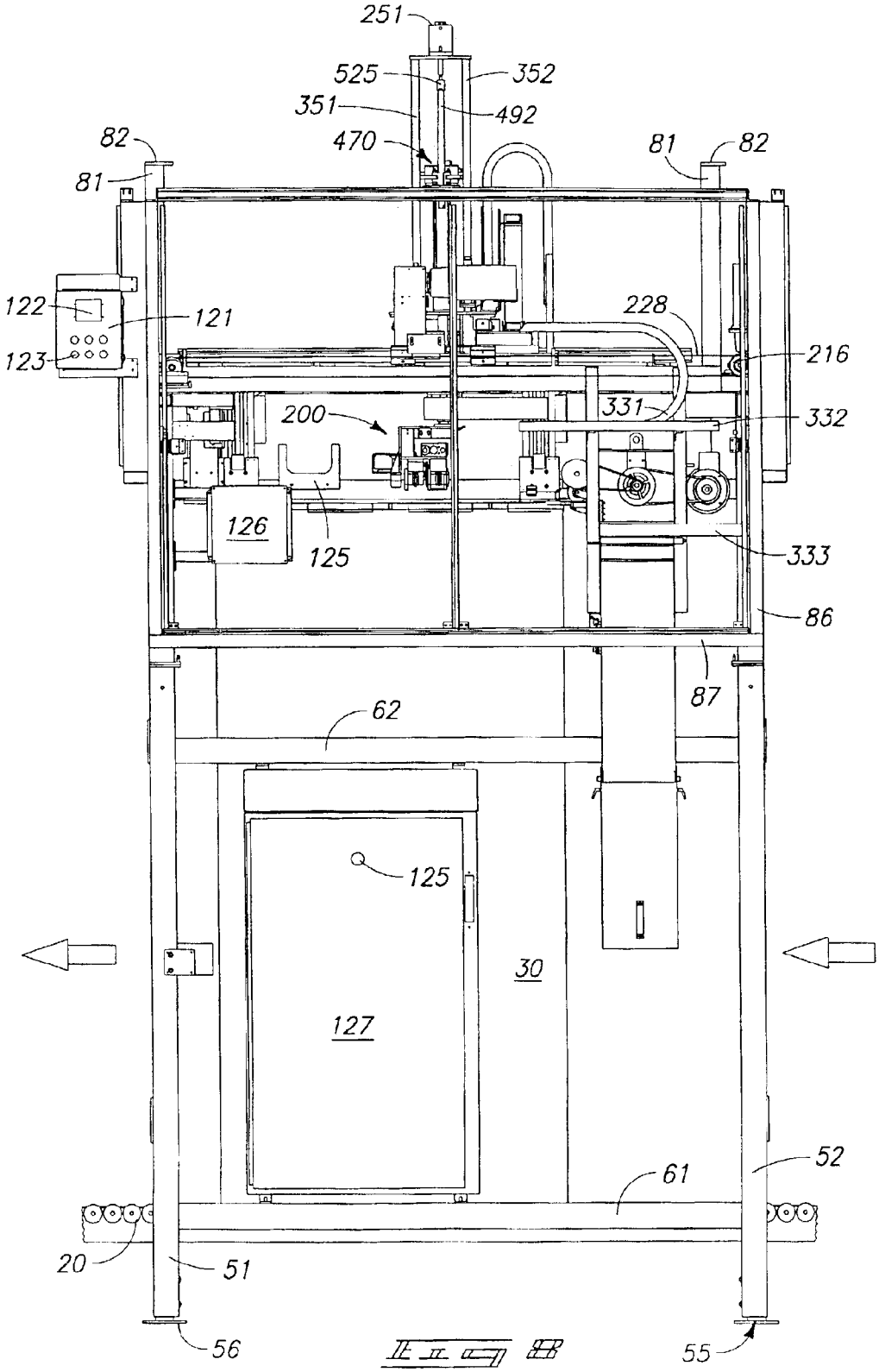
FIG. 8 is a front elevational view showing the embodiment of FIG. 1.

Attention should now be directed to FIG. 6 which shows pallet hold-down 101 in greater detail. Pallet hold-down 101 includes two pallet hold-down guide rods 106 and 107 which are coupled to a base member 108. A linear actuator 109 extends in parallel to and positioned between the guide rods 106 and 107 and is used to power the base plate 108 upwardly and downwardly. An engagement bracket or piece is connected to base plate 108 and is labeled 110 as best shown in FIG. 4. As can be seen in FIG. 4, the contact formed by bracket 110 is moved downwardly and against the upper corner of pallet 30 in order to engage the pallet and arrest its position within the debanding machine.

Although each of the other hold-down mechanisms may vary in particulars, each has a contact 110 which similarly bears upon the pallet, preferably near the corners of the pallet, to simultaneously arrest all four corners and prevent motion of the pallet during the debanding operation performed by machine 100.

The pallet hold-down clamps are preferably provided with a safety feature that keeps the clamps at their upward, retracted position even if electrical power or pneumatic pressure is lost to the machine. This is advantageously provided in the form of hold-down clamp safety mechanisms 146 best illustrated in FIGS. 6 and 9. Safety mechanisms 146 include a pneumatic actuator 147 connected at one end to the frame and the other end drives a small pivotal lever arm 148. The actuator 147 keeps the end of the lever arm from engaging under or otherwise with the end pieces 105 on guide rods 106 or 107. A spring (not shown) or gravity force of the mechanism bias the lever into a latched position. The powered operation of the unit applies air to the actuators 147 that prevent latching unless power or pressure are lost in which case the actuators no longer apply force. When the actuators release the safety mechanisms latch until power and pressure are restored.

Pallet Flow and Basic Operation

Returning again to FIG. 1, pallets 30 enter from the right side of FIG. 1 and are moved into a debanding operating position as shown in FIG. 1 using the facilities conveyor 20. The facilities conveyor is preferably controlled using a pallet position detector (not illustrated) that detects the position of the pallet and provides for the pallet to halt at the desired location within the debanding machine. Thereafter, the pallet hold-down mechanisms 100 are extended downwardly and brought into contact to arrest and secure the working position of the pallet.

After the pallet has been stopped and secured, the general operation of debanding the pallet is performed as more fully described below. After the debanding operation has been performed, then the pallet hold-down mechanisms 100 are retracted and the pallet is once again conveyed by conveyor 20 out the exit portal 139 at the left as shown in FIG. 1 and onto other processing, such as depalletizing the load contained on the pallet.

Overview of Control Structure

FIG. 1 also shows a primary control interface box 121 which includes a visual display 122 and a number of control keys 123 which are used by the operator to provide control instructions to the debanding machine. The control system also advantageously includes at least one emergency stop switch 125. As shown, there are two emergency stop switches 125 positioned near the rear left corner at upper and lower positions of FIG. 1 and on the control box 127.

The machine also includes a control wiring enclosure box 126 and a main control compartment 127 which are conveniently mounted to the framework at a suitable location, such as shown. A further control box (not shown) can be mounted to a control box support bracket 128 used to conveniently hold control wiring and junctures (not shown).

Movable Operating Head—Generally

Figure 21:
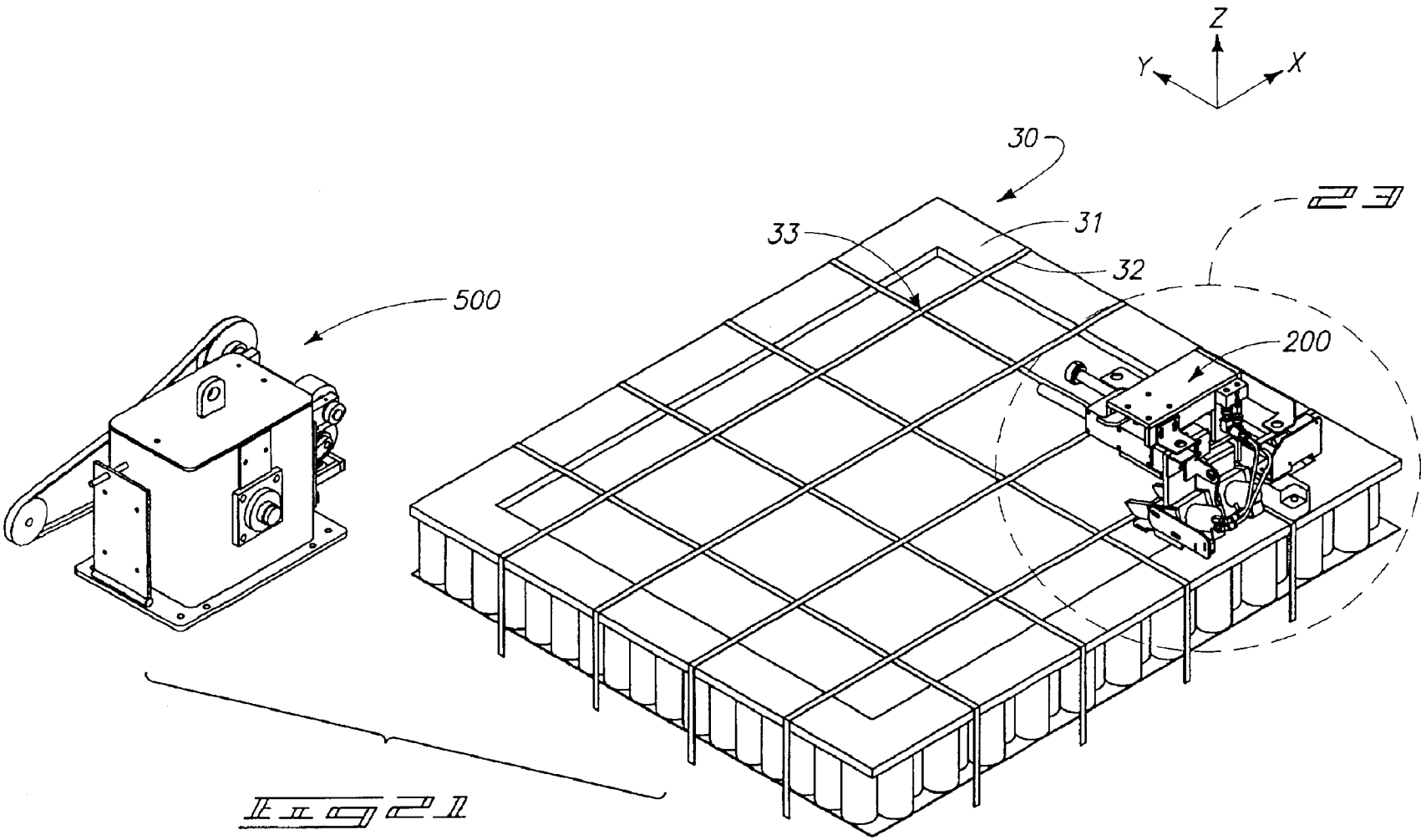
FIG. 21 is a diagrammatic view showing a portion of a pallet and portions of a movable head and chopper forming a part of the debanding machine of FIG. 1.
Figure 23:
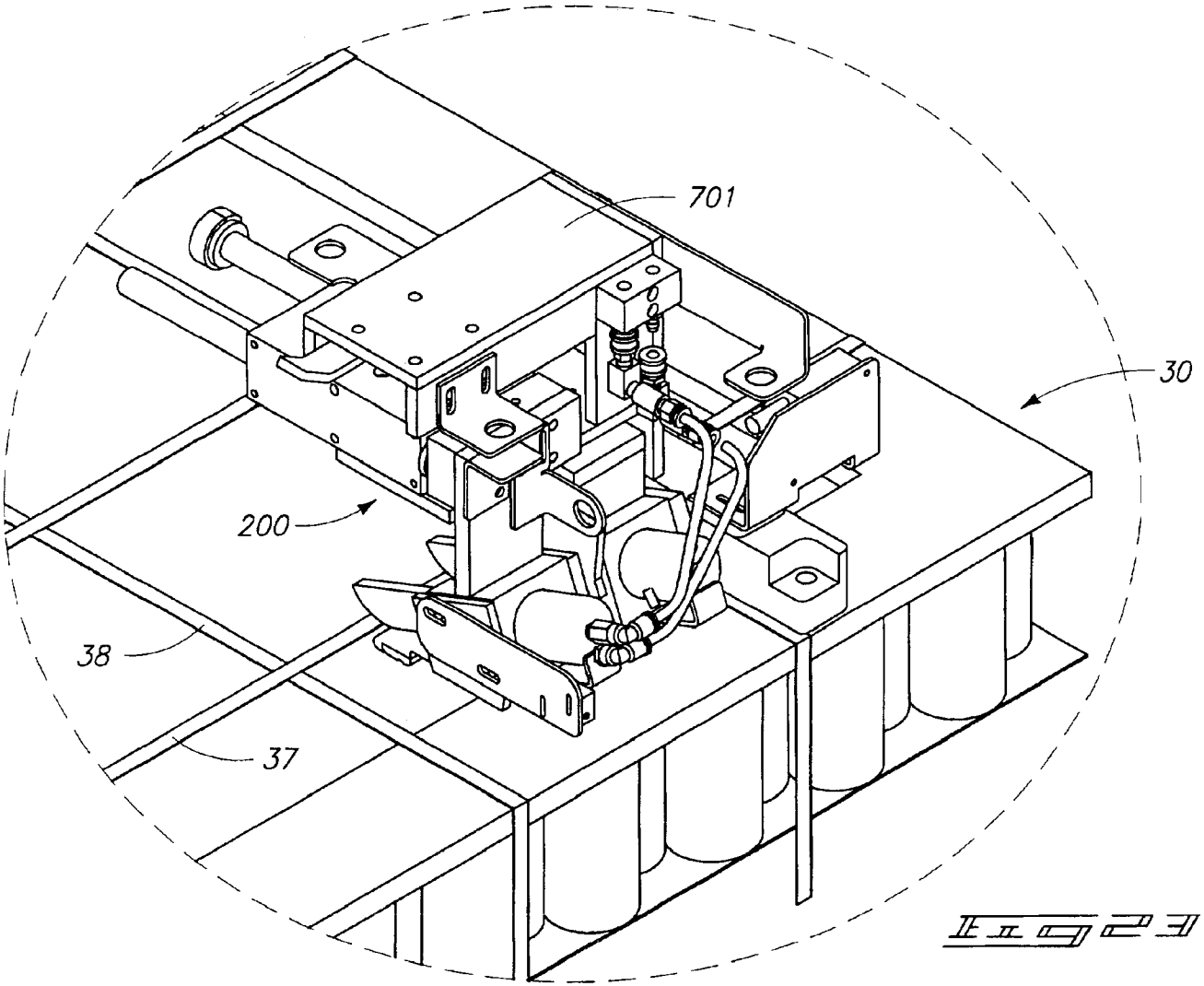
FIG. 23 is an enlarged perspective view showing detail from FIG. 21.

Refer now to FIG. 21 which shows in relative isolation a movable debanding operating head assembly 200. FIG. 23 shows the head in greater detail. It is also shown in many other Figs.

The details of movable head assembly 200 will be discussed in greater detail below. At this point, the reader should appreciate that head assembly 200 is shown in FIG. 21 in a position ready to engage a pallet having a series of pallet bands 32 and 33. Pallet 30 includes an upper frame piece 31 which extends about the top of the pallet and can be a perimeter frame or a full frame extending across the entire top of the pallet.

The contents of the pallet are secured using longitudinal bands which extend along the length of the pallet. Bands 32 are oriented in the X-direction. Transverse bands 33 extend transversely across the pallet extending in the Y-direction. Underlapping and overlapping intersection or crossing points designated at 33 exist at the various crossing illustrated in FIG. 21 between bands 32 and 33. Depending on the manner in which the pallet was made up, bands 32 may overlay or underlay bands 33, as was discussed above.

To automatically deband pallet 30 using machine 100, the head assembly 200 moves to appropriate orientations and positions to sense the bands, engage the bands, cut the bands and relocate the bands, as will be more completely described below. The head assembly can be positioned so as to engage either the longitudinal or transverse bands by rotation of the movable head using a rotation stage and associated operator which will be described in greater detail below. The rotational stage is mounted upon a spacial positioning mechanism which provides for adjustable positioning along the X, Y and Z directional axes. The spacial positioning mechanism and rotational mechanism will be described in greater detail below.

X-Stage

The spacial positioning mechanism includes an X-stage and associated X-stage operator that moves the X-stage to a desired position along the X-axis. The X-stage is supported upon the machine frame and the X-stage operator moves the X-stage assembly relative to the frame.

FIG. 4 shows that the frame includes a front guide rod 210 which extends longitudinally along the front of the debanding machine 10, such as supported by the longitudinal frame member 77. The guide rod is supported upon small support blocks which are between the rod 210 and frame member. A complimentary rear guide is used to support the opposing rear side of the X-stage assembly. This is advantageously provided in the form of a C-shaped guide rail 211. Guide rail 211 is mounted to the framework, such as along the back of machine 100 upon the longitudinal frame member 78 using small support blocks extending between these components.

Guide rail 210 is engaged by one or more linear slide blocks 212 which can be shown in greater detail in FIG. 7. Guide blocks 212 are used along the front guide rod 210 whereas rollers (not shown) are used with and positioned within the C-shaped guide channel 211 at the rear of machine to support the rear portion of the X-stage movable subassembly 220. The X-stage subassembly 220 moves left and right as illustrated in FIGS. 4 and 7 along the guides 210, 211 to assume various X-positions needed to position the movable head assembly 200 to engage the bands and otherwise perform the actions indicated herein.

X-Stage Operator Mechanism

The X-stage includes an X-stage operator which operates the X-stage subassembly into various positions. The X-stage operator is driven by an X-stage servo motor 222. X-stage servo motor 222 has an output shaft which is directly coupled into a X-stage gear box 224. X-stage gear box 224 is mounted upon the frame and includes bearings to support output shafts which extend out towards the front and rear of the gear box. As shown, the front output shaft of gear box 224 is fitted with a front drive sheave 216 which is used to drive and support a front X-stage drive belt 228.

The rear output shaft from gear box 224 is used to drive a transverse X-stage drive shaft 230. The rear end of drive shaft 230 is supported by bearing 231 mounted on the frame. Drive shaft 230 also mounts a rear drive sheave 232 which is used to drive a rear drive belt 233.

The opposing ends of drive belts 228 and 233 are trained about supporting sheaves 235 held by bearing blocks 236 which are fastened or otherwise suitably mounted on the frame. FIG. 6 shows this in greater detail. FIG. 6 also shows that secondary guide sheaves 241 can be mounted to the frame in order to position the drive belts over the hold-down actuators 100, as needed.

Figure 5:
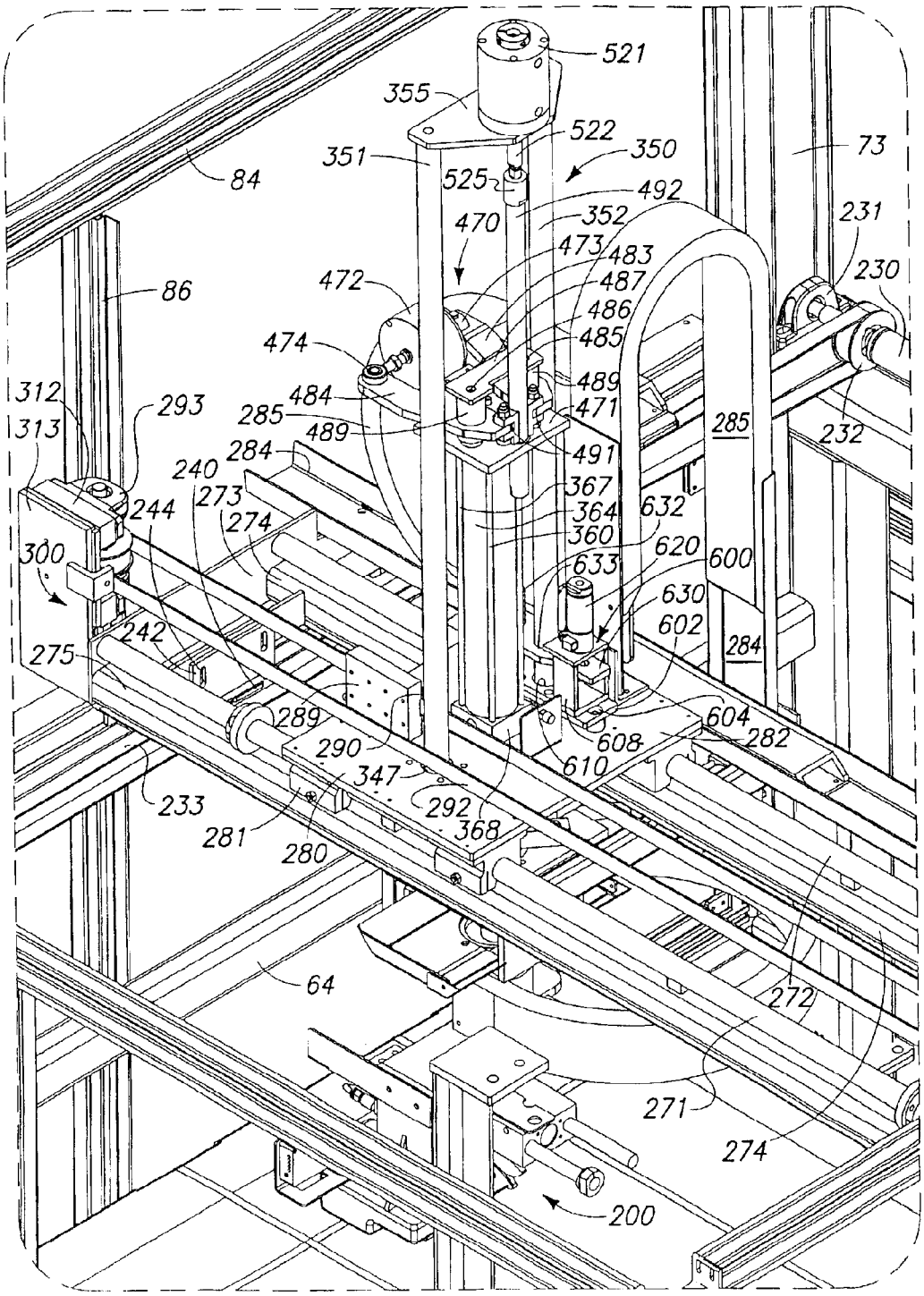
FIG. 5 is an enlarged view of a detailed portion of the embodiment of FIG. 1.

The upper runs of the drive belts for the X-stage are coupled to their respective ends of the X-stage support platform using drive belt connection fixtures shown most clearly in either FIG. 7, or alternatively in FIG. 5. The drive belt connection fixture includes a belt coupling 240 and associated coupling bracket 242. The belt coupling 240 is fastened to the underside of the coupling bracket or piece 242. The drive belts 233 or 228 are captured between mating pieces of coupling 240. This is accomplished using fasteners (not shown). The coupling bracket 242 connects to the X-stage platform using fasteners which extend through apertures 244, (fasteners not shown).

Motion of X-stage drive motor 242 causes the drive belts to be moved thus causing each end of the X-stage platform to be simultaneously moved similar amounts. This drive configuration thus helps to minimize racking and mislocation of the X-stage platform relative to the frame and supporting guides 210 and 211.

The X-stage platform is advantageously constructed to slidably support a Y-stage platform 280 and associated operator. The Y-stage platform 280 is shown in detail in FIG. 5. Y-stage platform 280 includes slide blocks 281 which are arranged to engage with Y-stage support rods 271 and 272 which form a part of the X-stage platform structure. Guide rods 271 and 272 are mounted by end plates 273. The opposing front and rear end plates 273 are connected by two transverse X-stage platform chassis members 274 and 275. X-stage chassis members which act as the main transverse members extending between the X-stage support guides 210 and 211.

FIG. 5 further shows that the X-stage platform is provided with a Y-stage operator or drive mechanism 300 which will be detailed below.

FIG. 5 still further shows that the X-stage platform structure may include a cable guide support channel 284 and associated cable guide 285. Cable guide 285 is a flexible mechanism similar to a chain in appearance that encloses and protects cables yet allows them to flex as a combined unit to allow relative movement. In this case cable guide 285 allows movement between the cables on the X-stage and Y-stage. Electrical and control cables (not shown) are supported within the cable guide 285 to provide electrical power, air power and control information between the X-stage platform and the Y-stage which is movable relative thereto.

FIGS. 4 and 7 show that the X-stage is supplied with electrical power, air power and control cabling using another cable guide 331 which is supported by a cable guide support channel 332 mounted on the frame using an ancillary cable guide support framework 333. Cable guide 331 moves in response to longitudinal movement of the X-stage platform helping to maintain the various electrical, pneumatic and control cables in a desired constrained configuration.

Y-Stage Platform

As briefly explained above in connection with FIG. 5, the Y-stage includes a Y-stage platform 280 supported in slidable relation to the X-stage. This is advantageously done using slide blocks 281 which are at four corners of a platform plate 287. Y-stage platform plate 287 is used to support a vertical or Z-stage and associated operator generally referred to as 350 which will be detailed below.

Y-stage platform 280 also includes a mounting bracket 289 which serves as a Y-stage operator drive connection. The Y-stage operator drive connection further includes a complimentary coupling 290 which is fastened to connection bracket 289 using fasteners which extend through the apertures illustrated in FIG. 5. Parts 289 and 290 are thus secured to the Y-stage drive belt 292. Drive belt 292 is moved so as to position the Y-stage at various transverse positions along the supporting slide bars 271 and 272 forming part of the X-stage platform.

Y-Stage Operator

FIG. 4 shows that the X-stage platform also supports a Y-stage drive motor 301 which is mounted to the X-stage platform using suitable brackets 302 and 303. The drive motor 301 has an output shaft (not illustrated) which is coupled to a Y-stage drive gear set 305. Y-stage gear box 305 is mounted on brackets 302 and 303. A depending output shaft from gear box 305 mounts a primary sheave 308 which is used to support and drive the Y-stage drive belt 292. The rear end of drive belt 292 is supported using a secondary or idler sheave 293 illustrated best in FIG. 5. Sheave 293 is supported by pillow block support bearings 312 mounted using a drive belt extension bracket 313. Rotation of the motor 301 causes the Y-stage drive belt 292 to move in either direction rotating the supporting sheaves and moving the Y-stage drive belt coupler 289 to relocate the Y-stage platform 280 to a desired position.

Z-Stage Subassembly and Operators—Generally

Debanding machine 10 preferably includes at least one Z-stage or vertical stage which is movable to adjust the vertical position of the movable head 200. The preferred embodiment shown and described herein advantageously includes two Z-stage operators which serve in somewhat different capacities as will be detailed below. The Z-stage operators are generally referenced by number 350 in FIG. 5 and elsewhere. It may be suitable in some implementations of the invention to use a Z-stage which uses a single operator rather than the preferred two operators shown and described herein.

FIG. 5 shows that the Z-stage subassembly includes two slidable guide rods 351 and 352 which are mounted through apertures 347 in the Y-stage platform piece 287. The upper end of guide rods 351 and 352 are connected together using an upper guide assembly plate 355. The guide rods and assembly plate 355 move vertically relative to the Y-stage platform. The guide rods 351 and 352 extend through the Y-stage platform downwardly to depend toward the receiver area in which the pallet is received and held during the debanding operations.

The two operators used to move the Z-stage are a first or primary actuator which, as shown, is a pneumatic cylinder 360 having an extendible ram that is deployed beneath the Y-stage platform to lower the movable head 200. The primary actuator 360 is used to make major adjustments of vertical position which are associated with adjusting the machine for a particular height of pallet. The second or secondary actuator is, as shown, another pneumatic actuator 521 which provides a smaller amount of vertical travel. The secondary actuator 521 is used after the pallet height has been determined and adjustment of the primary actuator has been made. The secondary actuator is used to make vertical height changes needed during movement of the head 200 during the cutting, gripping, and other operations associated with actual debanding operations.

Z-Stage Primary Operator

FIG. 5 further shows that the Z-stage primary actuator 360 is advantageously mounted upon the Y-stage platform piece 287. The preferred pneumatic operator 360 is a pneumatic cylinder or ram having an actuated piston with attached output rod 361 (not shown in FIG. 5, see FIG. 15) which extends downwardly beneath the Y-stage mounting platform 287. Gravity forces the weight of subassembly supported on the actuator output shaft downwardly. Air is controllably supplied to actuator 360 to raise the supported assembly, including movable head 200 upwardly.

The primary Z-stage operator 360 has an external housing 366 which includes assembly rods 367 at each corner. The assembly rods are used to connect opposing end plates 368 at the upper and lower end of actuator 360.

Figure 20:
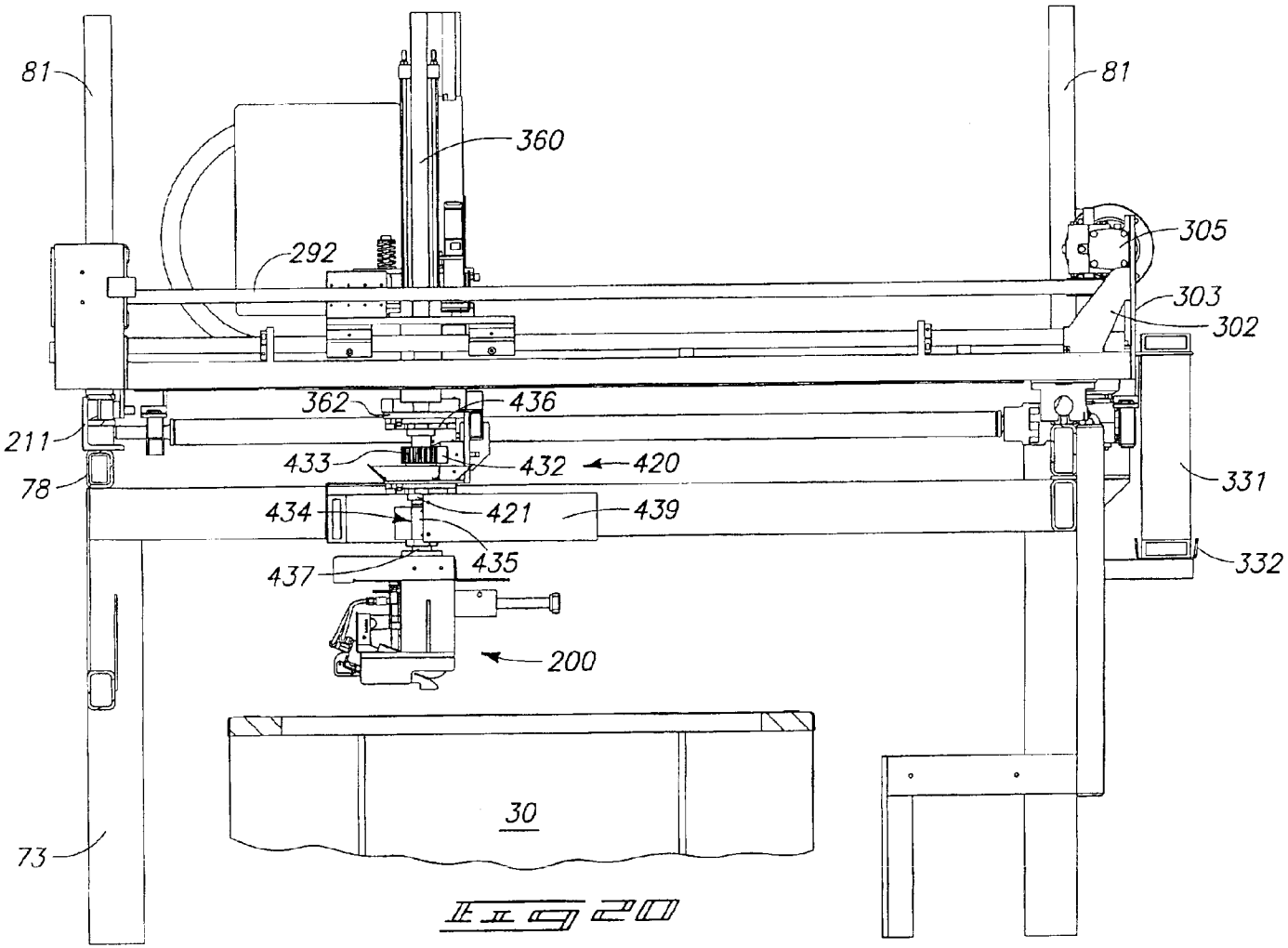
FIG. 20 is a sectional view taken along line 20—20 of FIG. 17.

FIG. 20 shows the primary vertical actuator 360 with output rod 361. Output rod 361 and associated guide rods 351 and 352 are connected to a vertical stage output mounting plate 362 which carries a rotational stage operator 420 which will be detailed below. The rotational stage operator 420 has an output shaft 421 which is connected to the movable head 200 to rotate the movable head over a suitable rotational arc, such as somewhat greater than 90°. This rotational capability is desired when positioning the head between orientations to cut the transverse versus longitudinal bands from a pallet.

Z-Stage Secondary Operator

The Z-stage also has a secondary actuator 521 which is advantageously a pneumatic actuator which extends and contracts to provide relative movement between the actuator housing and an output rod 522. If left unclamped the output rod 522 would be moved downwardly in FIG. 5 with extension of the actuator, and upwardly with contraction of the actuator.

The output rod 522 of secondary Z-stage actuator 521 is connected to a clamping tube 492 using a coupling 525 which is detachable from the output shaft 522.

The operation of the secondary operator will be given below after first describing the clamping mechanism with which the secondary actuator is used.

Z-Stage Clamping Mechanism

FIG. 5 shows that the upper end of actuator 360 serves to mount an elevational clamping mechanism 470. Elevational clamping mechanism 470 is supported on a base plate 471 which is connected to the upper end piece 368 of actuator 360. Alternatively, the clamping mechanism base plate may otherwise be supported in a stationary position.

Clamping mechanism 470 includes a pneumatic or other suitable operator 472 which expands and contracts. Operator 472 has output connections 473 and 474 at opposing sides of the cylindrically shaped operator 472. One output connection 473 is connected to a first arm 483. The second output is connected to a second arm 484.

Clamping mechanism arms 483 and 484 are supported for pivotal action at fulcrum points or pivot axes 485 and 486, respectively. The fulcrum points are kept at a defined spacing below the arms by the associated connection points on the base plate 471. A retainer piece 487 also extends between the fulcrum points 485 and 486 to maintain the mechanical spacing thereof along the upper sides of arms 483 and 484.

The fulcrum points 485 and 486 have associated pivot shafts (not shown). The pivot shafts preferably are formed by bolts or other suitable shafts or pins. In the construction shown the pivot shafts are formed by bolts which simultaneously function as fasteners extending through the spacer plate 487 and into the base plate 471. Bushings 489 are positioned about the shafts and act to maintain vertical positions of the parts so that added pressure does not bear upon arm pieces 483 and 484 when the assembly is made up tight.

The clamping mechanism further includes contact jaws 491 which are expandable and contractible using operator 472. Contact jaws 491 bear against clamping rod member 492. The clamping jaws 491 are preferably pivotally mounted to the engagement ends of the arms 483 and 484 to bear against clamping rod 492 with better alignment.

Operation of Z-Stage

Vertical adjustment of the operational head 200 is provided by the Z-stage. Major movements are needed to sense the top of the pallet and to allow a range of pallet sizes to be processed. After a pallet has been placed in the receiver and secured in position, then the head is moved to a position where it can be used to sense the height of the pallet top. This is done by releasing pressure from the main or primary actuator 360 to thus allow it to drop under the force of gravity. The head 200 contacts the pallet and vertical movement stops. This acts to detect and determine the pallet height.

After the head has contacted the pallet to thus determine the pallet height, then the clamping mechanism is employed to clamp rod 492 into a stationary position. Thereafter the secondary actuator is activated and is used to lift or lower the plate 355 and attached guide rods 351 and 352. The plate is lifted when the secondary actuator 521 is extended because the rod 492 is clamped in a stationary position. The plate is lowered when the secondary actuator 521 is contracted. The output rod 522 is stationary and the actuator house which is attached to the plate 355 moves. Since the attached guide rods 351 and 352 move upward and downward the output of the vertical stage moves the head 200 to the desired elevation.

Z-Stage Safety Brake

The debanding machine 10 also preferably includes a Z-stage safety brake assembly shown in FIG. 5 by the reference number 600. The safety brake assembly is mounted upon the Y-stage platform piece 287. The safety brake 600 includes a base piece 602 which is secured to Y-stage platform piece 287 using suitable fasteners extending through fastener aperture 604. Base piece 602 supports and actuator mount 608 which is secured thereto using a suitable means such as fasteners (not shown) which extend through apertures in the mounting piece 608 and secure it to the base piece 602. The base piece and actuator mount include guide rod apertures therethrough referenced by numeral 610. Guide rod 352 extends through such apertures and on through the Y-stage platform.

The safety brake 600 also includes a safety brake actuator 620 which is a pneumatic ram as shown. Actuator 620 has an output shaft not visible in FIG. 5 which extends downwardly and connects with a tilting bind plate 630. Bind plate 630 is mounted for tilting action on the opposite or rearward end of the assembly and is spring loaded in one direction using tilt plate spring 632. Actuator 620 forces the tilt plate 630 into a position approximately parallel with the Y-stage platform thus aligning a guide rod aperture 633 so as to allow guide rod 352 to pass easily therethrough without binding action. Upon loss of pneumatic power to actuator 620, then the action of biasing spring 632 causes the tilt plate to become angled and bind the guide rod 352 within aperture 633 to thus act as a brake and prevent any motion of the Z-stage movable assembly during a power outage or other shutdown condition.

Movable Head Rotational Stage

Rotational stage 420 is mounted upon the lower end of the Z-stage which controls the vertical elevation of the rotational stage. FIG. 16 shows this arrangement as does FIGS. 17–20. Rotational stage 420 includes a rotational stage framework 423 mounted upon the lower output end of the Z-stage operator. Mounting piece or frame 423 mounts a rotational stage actuator 430 which is a pneumatic actuator coupled at one end to the rotational stage frame 423 and at the opposite end to a gear rack 432. FIG. 20 shows that gear rack 432 engages with a pinion gear 433 which is mounted upon a rotational stage rotating assembly 434. The rotational stage rotating assembly 434 is suitably mounted using bearings to the rotational stage frame 423. As shown, this is accomplished using a bearing assembly 435. The upper end of the rotational stage rotor assembly is supported by an upper bearing assembly 436.

When the rotational stage actuator 430 is activated, rack 432 moves and drives pinion 433 rotationally to pivot the output shaft 437. The mechanism is preferably designed to have an arcuate range of motion of at least approximately 100°–110° so as to allow easy reorientation of the movable head 200 over a common traveling range of approximately 90° of arc.

The rotational stage also includes a cable guide 439 which allows electrical, pneumatic and control cabling to neatly play out and be recoiled as the movable head 200 is rotated. Cable guide 439 does not rotate with the rotor of the rotational stage but is mounted upon the other components secured to the rotational stage mounting plate 362.

Operational Head Structure

The debanding apparatus includes a movable operational head 200 which has a number of components which will now be described in connection with FIGS. 25–30. The head includes a head frame 700 which is advantageously assembled from weldments and other parts which are securely affixed. As shown, head frame 700 includes a mounting plate 701 which is connected to the rotating output shaft from the rotational stage described above. Frame 700 also includes a second frame piece 702 which is connected to frame piece 701 and extends downwardly. Frame piece 702 includes a gusset piece 703 used to help secure a fourth frame piece 704. A fifth frame piece 705 extends from second frame piece 702 and is used to mount a cutting assembly 720 in movable relationship to other portions of the movable head.

Frame 700 may also include a variety of mounting brackets. Mounting brackets 711 is used to support a band detector not shown in FIGS. 25–30, but which is illustrated in other views and will be discussed in greater detail below. The frame further includes a second mounting bracket 712 also used to support a detector. A further frame bracket 713 is also provided to mount a proximity detector which is used to detect position and/or travel of the movable cutter assembly using a proximity switch or other suitable position detector (not shown).

Frame 700 also mounts a contact pad 730 which is preferably fastened to frame piece 704 using fasteners which extend through apertures 731 and into frame piece 704. Contact piece 730 is used when the movable head is extended downwardly to contact the top of the pallet 30 to detect the, pallet height. It also shields remaining portions of the head against direct physical contact with the pallet until specifically intended during operation of the head.

Band Stationary Guide

Figure 25:
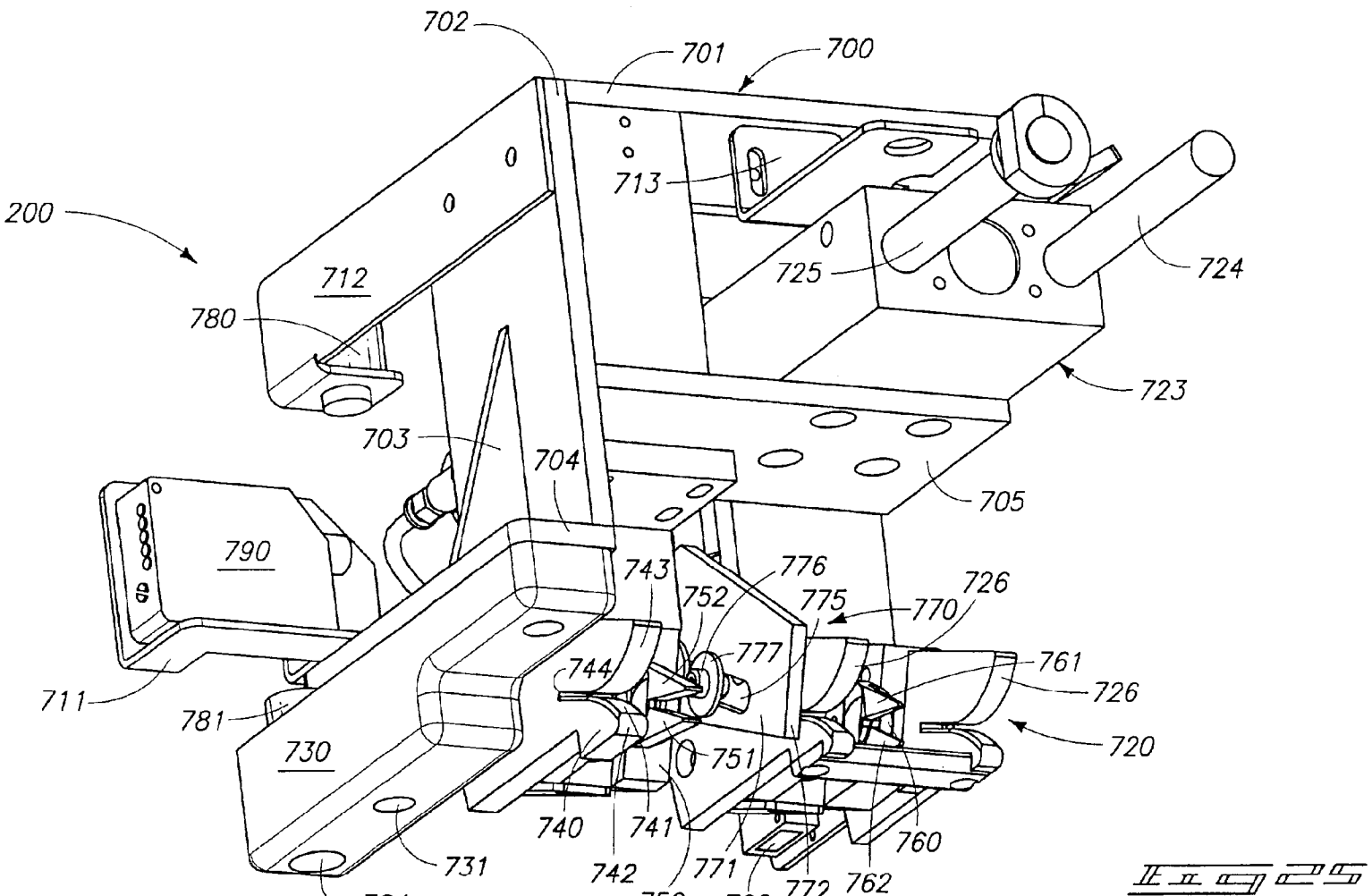
FIG. 25 shows a perspective view of a movable head portion of the debanding machine of FIG. 1 in isolation with the viewer's perspective looking into the cutter and gripping jaws.

FIG. 25 best shows that movable head 200 includes a stationary band guide 740. Stationary band guide 740 preferably has a band guide mount 741 which includes two converging band guide faces. The band guide faces include lower band guide face 742 and upper band guide face 743. The iv band guide faces are preferably curved and converge inwardly to a band guide slot 744. Band guide slot 744 is advantageously provided with a boxed interior end with an abutment face against which bands come into contact when fully inserted into the stationary band guide.

Band Gripper Assembly

The movable head 200 further includes a band gripper assembly which is advantageously used to grip bands which have been positioned within the stationary band guide 740. Band gripper assembly 750 includes gripper jaws 751 and 752 which are movable relative to each other in order to expand and contract. In the expanded mode, the pallet bands come within the opposing contact faces of the band jaws 751 and 752. Upon contraction of the band jaws together, the bands are gripped and securely held therebetween.

The band gripper 750 is used to hold the band during cutting and also to retain the band to the movable head 200 as the band is moved within the debanding machine so as to bring it into position to be processed, such as by the band chopper 500 which is detailed below.

Band Cutter Assembly

Figure 24:
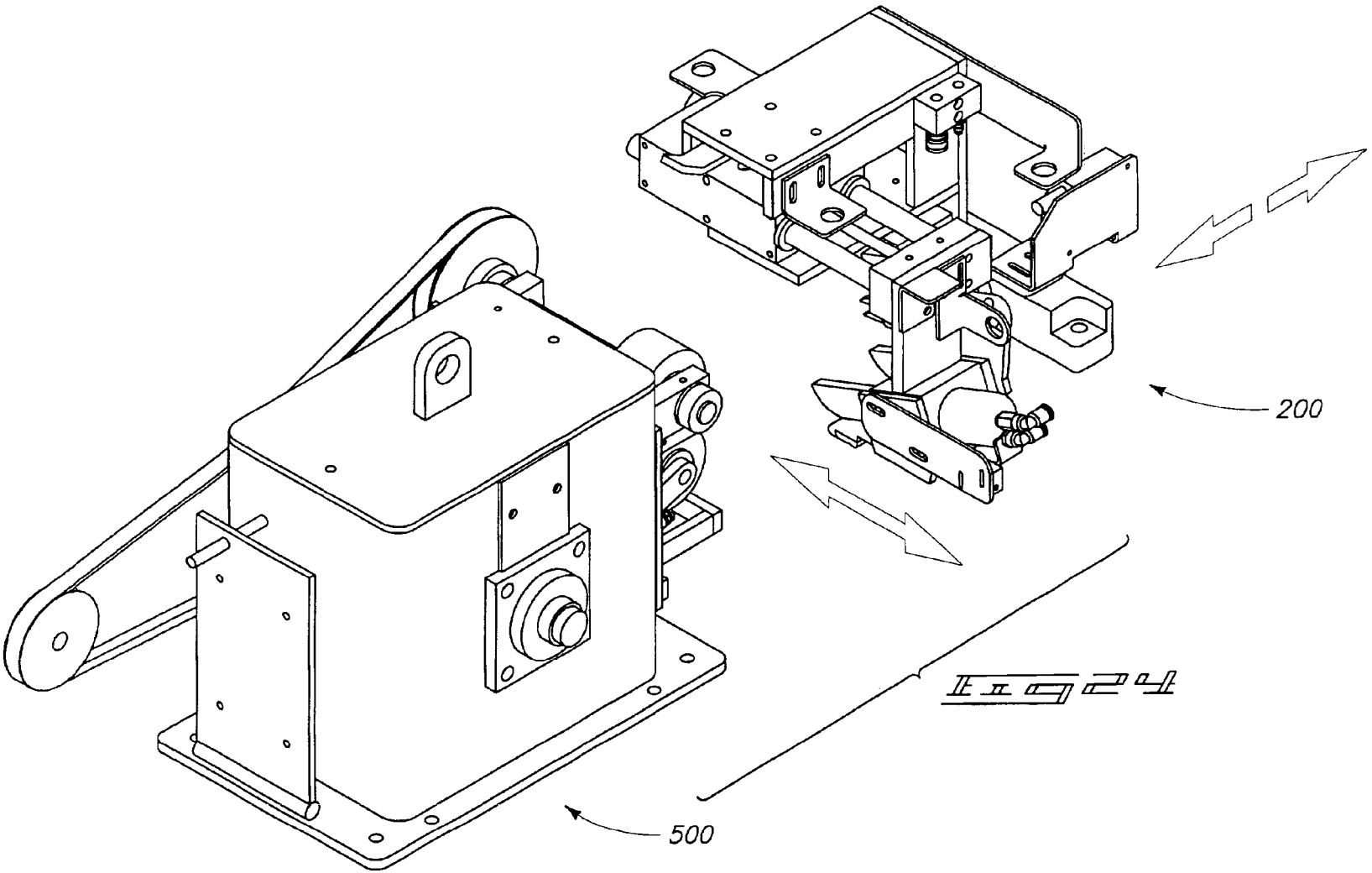
FIG. 24 is an enlarged view showing detail from FIG. 22.

Movable head 200 includes a band cutter assembly 720 which is used to cut a band which has been properly engaged by the movable head The cutter assembly may be moved relative to the movable head frame 700 in a manner which extends and retracts the cutter assembly. FIGS. 23 and 25 show the cutter assembly extended outwardly. FIG. 24 shows the cutter assembly retracted.

Figure 26:
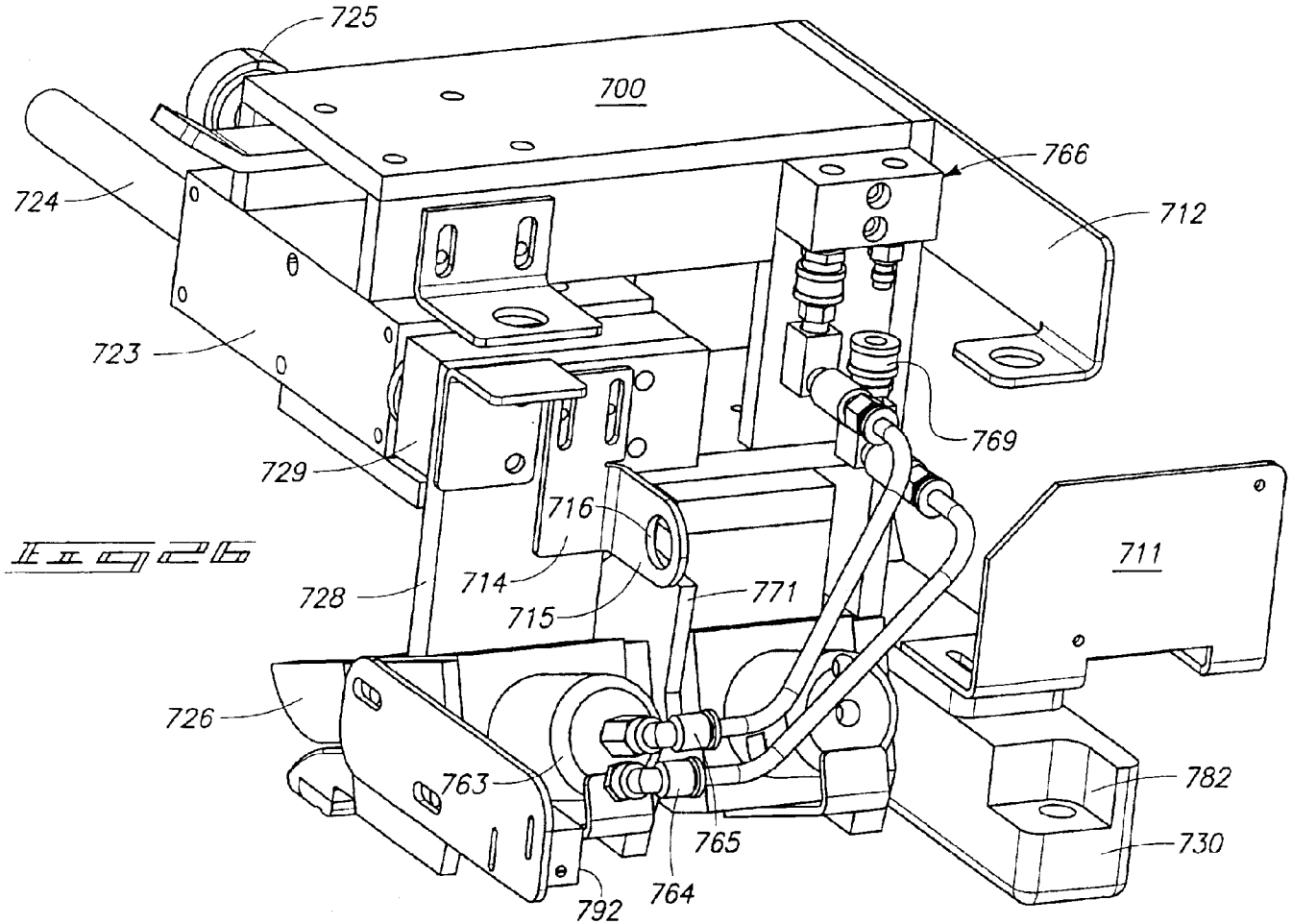
FIG. 26 is an enlarged perspective view of the subassembly of FIG. 25 shown from the rear of the subassembly.
Figure 27:
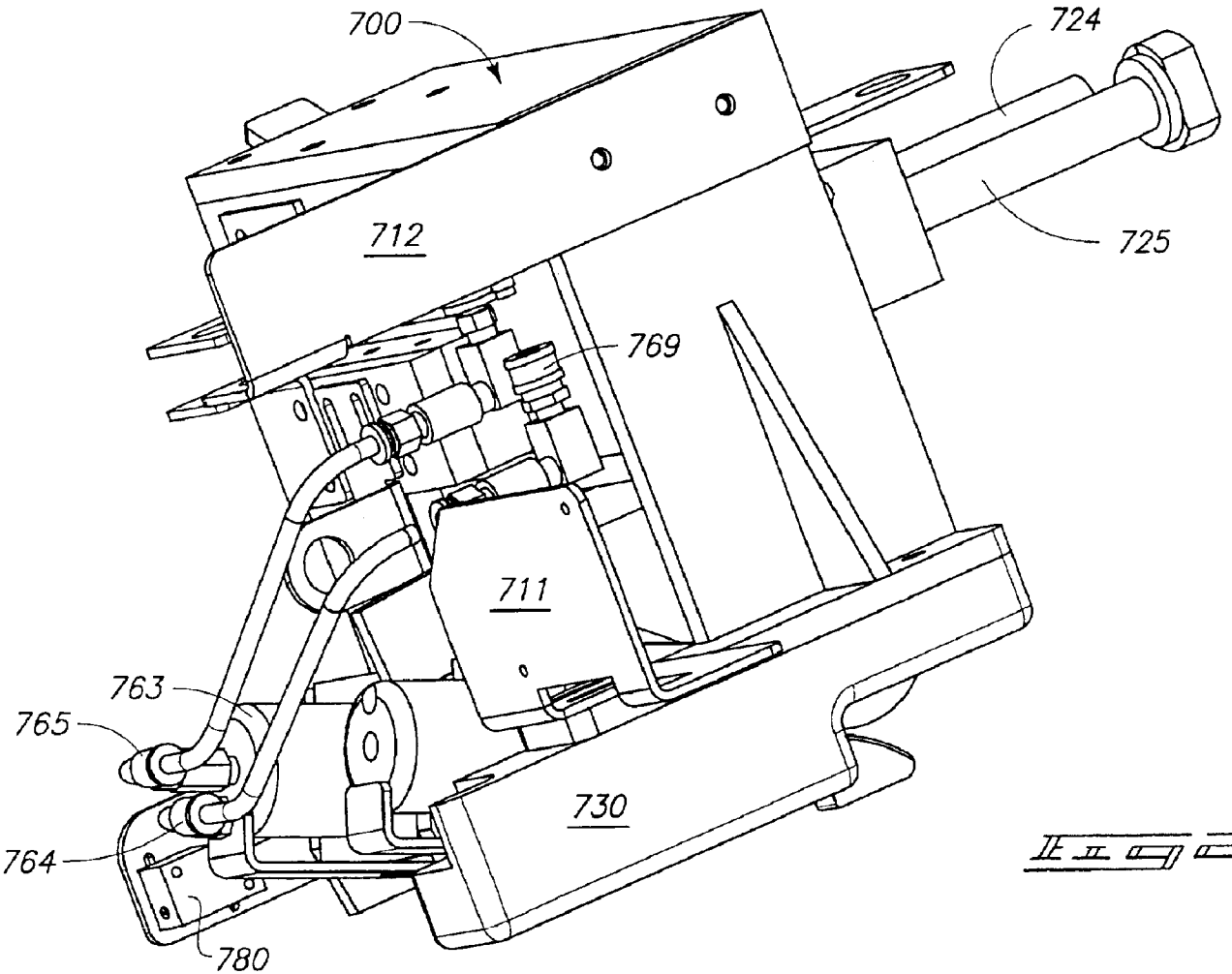
FIG. 27 is a further perspective view of the subassembly of FIG. 25 shown from another oblique rear viewing angle.
Figure 28:
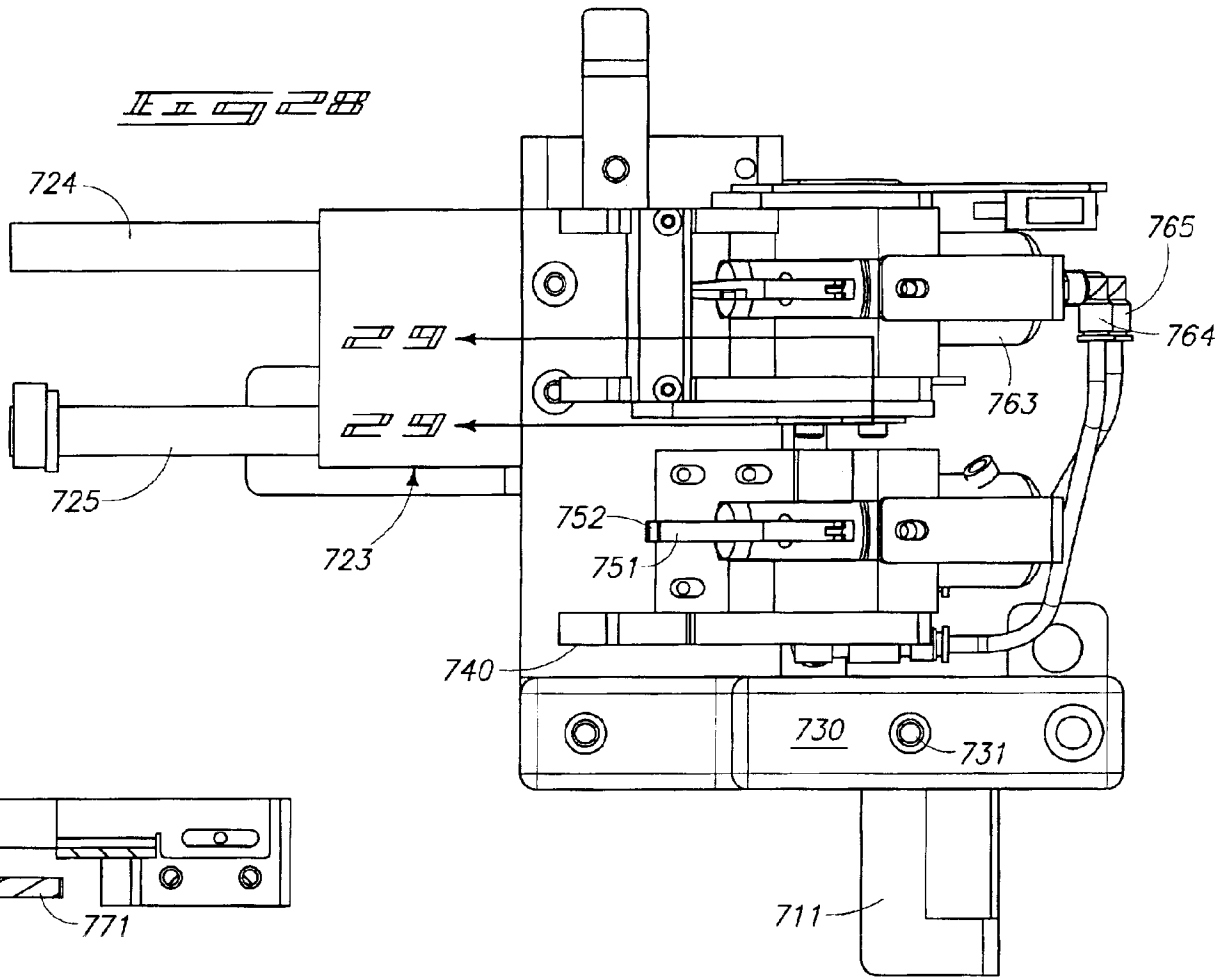
FIG. 28 is a bottom view of the subassembly of FIG. 25.
Figure 29:
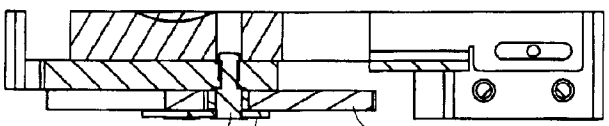
FIG. 29 is a sectional view taken along section lines 29—29 of FIG. 28
Figure 30:
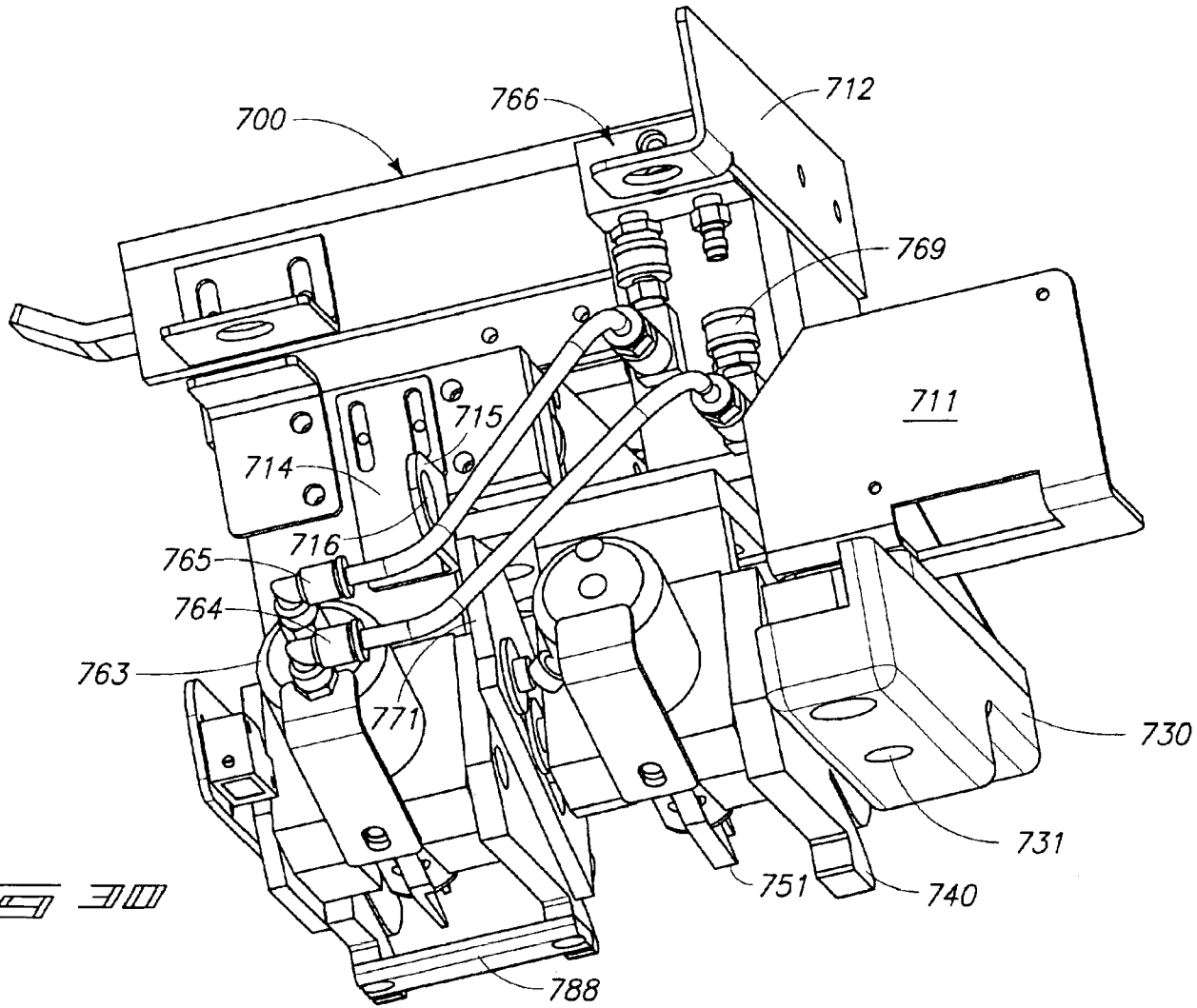
FIG. 30 is another perspective view of the subassembly of FIG. 25 shown from a further viewing perspective generally from the lower rear of the movable head.

The band cutter assembly includes a cutter assembly actuator 723 which has associated guide rods 724 and 725 which guide and prevent rotation of the movable portions of the assembly when such are moved between the extended and retracted positions. Cutter assembly actuator 723 is advantageously a pneumatic actuator which has a body portion attached to head frame piece 700. FIG. 26 shows a movable part 729. Attached to the movable part 729 is a mounting plate 728 which supports the suspended portions of the cutter assembly.

FIG. 23 shows the movable head 200 in position to engage a band and the cutter assembly portion of the movable head is extended. FIG. 24 shows the cutter head portion of the movable head retracted. This action of retraction is provided for so that the cutter assembly can be moved backwardly when a band is to be fed into the chopper as indicated in FIG. 24.

The cutter assembly also and preferably includes two cutter guides 726 which have converging guide surfaces similar to the stationary guide 740 discussed hereinabove. Cutter assembly further includes a pincher or other cutting tool 760 which has two jaws 761 and 762 which are operated using a pneumatic operator 763 as illustrated in FIG. 26. Operator 763 is provided with controlled pneumatic pressure and pressure relief using cutter actuation lines 764 and 765. Supply lines 764 and 765 are connected to a movable head pneumatic fitting mounting block assembly 766. Lines 764 and 765 are preferably flexible so as to allow the cutting head assembly to move relative to the frame portion of the movable head. This occurs when moving between the extended and retracted positions discussed above. Line 764 and 765 can include detachable couplings or other connections 769 or other couplings as desired.

Band Engagement Detector

The movable head assembly 200 also includes a band detector which is used to detect when a band has entered the guides 740 and 726. This is advantageously accomplished using a band detector mechanism which is mounted upon the cutter assembly which is movable relative to the head frame 700. As shown, band detector 770 (see FIG. 25 ) includes a contact plate 771. Contact plate 771 has a contact surface 772 which is along a nose or other appropriate point where a band entering the guides 740 and 726 will bear upon surface 772 and displace the detector plate 771. The detector plate 771 is provided with the ability to move relative to other parts of the cutter assembly. As shown, this is accomplished using a plurality of mounting slots 775 to which are extended detection plate mounting fasteners 776 which may have retainer washers 777 included thereon. Detection plate 771 moves relative to fasteners 776.

FIG. 26 shows detection plate 771 from the rear of the movable head assembly. Detection plate 771 moves rearwardly as just explained in response to being contacted by a pallet band as the movable head is moved into engagement and the band becomes positioned within the guides. A mounting bracket 714 connected to the back of cutter assembly includes an extension arm 715 which mounts a proximity detector which is mounted using aperture 716 and detects the movement of plate 771 to indicate that a band has been properly received in the engaged position. This is used as part of the overlay analyzer as will be explained in greater detail below.

Scanning Band Detector

The debanding machine 10 is provided with at least one band detector for detecting the pallet bands 37 and 38. The band detector may be an optical band detector 780 or an ultrasonic detector 781. Detectors 780 and 781 are only illustrated in FIG. 25. Other views show merely the mounting brackets. It is possible to use one or both detectors to obtain information on the positions and numbers of bands present on the pallet.

The preferred construction places the band detector or detectors on the movable head 200. This allows the band detectors to detect the pallet bands by scanning as head 200 is moved across the pallet adjacent to the surface being reviewed. As shown, this is done by scanning the head across the upper or top surface of the pallet 30. The head is preferably controlled to move at a slower speed when the detector is in the vicinity of a band. A band vicinity can be programmed into the controller, or it can be based upon band pattern information already stored in the debander control system.

The band detector may employ optical detection technology, ultrasonic beam detection technology or other suitable units that have the ability to discern and discriminate a pallet band in a reliable fashion. A suitable optical detector is a Model SME312d manufactured by Banner Engineering Corp. of Minneapolis, Minn. A suitable ultrasonic detector is Model SM380A-228-00 manufactured by Hyde Park Electronics, Inc. of Dayton, Ohio. Other detectors now known or hereafter developed may be appropriate for use as the band detector.

Band detector 780 can be mounted in a variety of locations upon the head. As shown, optical detector 780 is mounted to a bracket 712. Ultrasonic detector 781 is mounted in a mounting notch 782 (see FIG. 26) formed in the upper rear portion of contact pad 730. The ultrasonic beam is directed from the ultrasonic detector through aperture 784 through the contact pad and reflected ultrasonic waves are bounced back and detected by detector 781.

Frame Detectors

FIG. 25 shows a first frame detector 790. Frame detector 790 is directed downwardly to detect the edge of a pallet and provide information to the control system indicating the edge position. Detector 790 can advantageously be an optical or other suitable detector. One acceptable type of detector is a photocell detector. A suitable detector is Model SME312D manufactured by Banner Engineering Corp. of Minneapolis. This model has adjustable background suppression capability which has been found desirable in some situations.

The position of the pallet frame edge is determined by the readings given by the X-stage and Y-stage servo motors which have encoders included therewith that are read electronically. The information is stored in memory in the machine controller.

The movable head may also be provided with an optional second frame detector 792. Detector 792 is directed downwardly to sense the pallet top frame. Where employed, it may be which is used to detect the width of any top frame present on the pallet. As shown, frame detector 792 is an optical detector, but may be of alternative types or configurations.

Other Detectors

The receiving bay in which the pallets are secured may also be fitted with position detectors (not shown) which can be used to detect when a pallet is present and whether the pallet is of a minimum height. The detectors may employ a variety of detector types, such as light emitting beam detector pairs, or others.

The debanding machine also preferably includes suitable detectors or sensors (not illustrated) which detect when the various movable assemblies have reached their desired positions. This is communication to the control system as a check on proper operation.

Band Chopper

The debanding machine 10 also preferably includes a band chopper 500. FIG. 1 shows the general position of chopper 500 and the outflow or discharge chute 501. The discharge chute is preferably angled outwardly from the chopper toward a discharge end. The discharge of the chute is preferably provided with a pivotal end section 502 which can be positioned in a receptacle or container (not shown) which receives the chopped pieces of bands 37 and 38 which are produced. The resulting pieces are typically recycled or otherwise disposed of. They may also be conveyed away from chute 501 using an air conveyor tube system present at the plant where machine 10 is installed.

Figure 31:
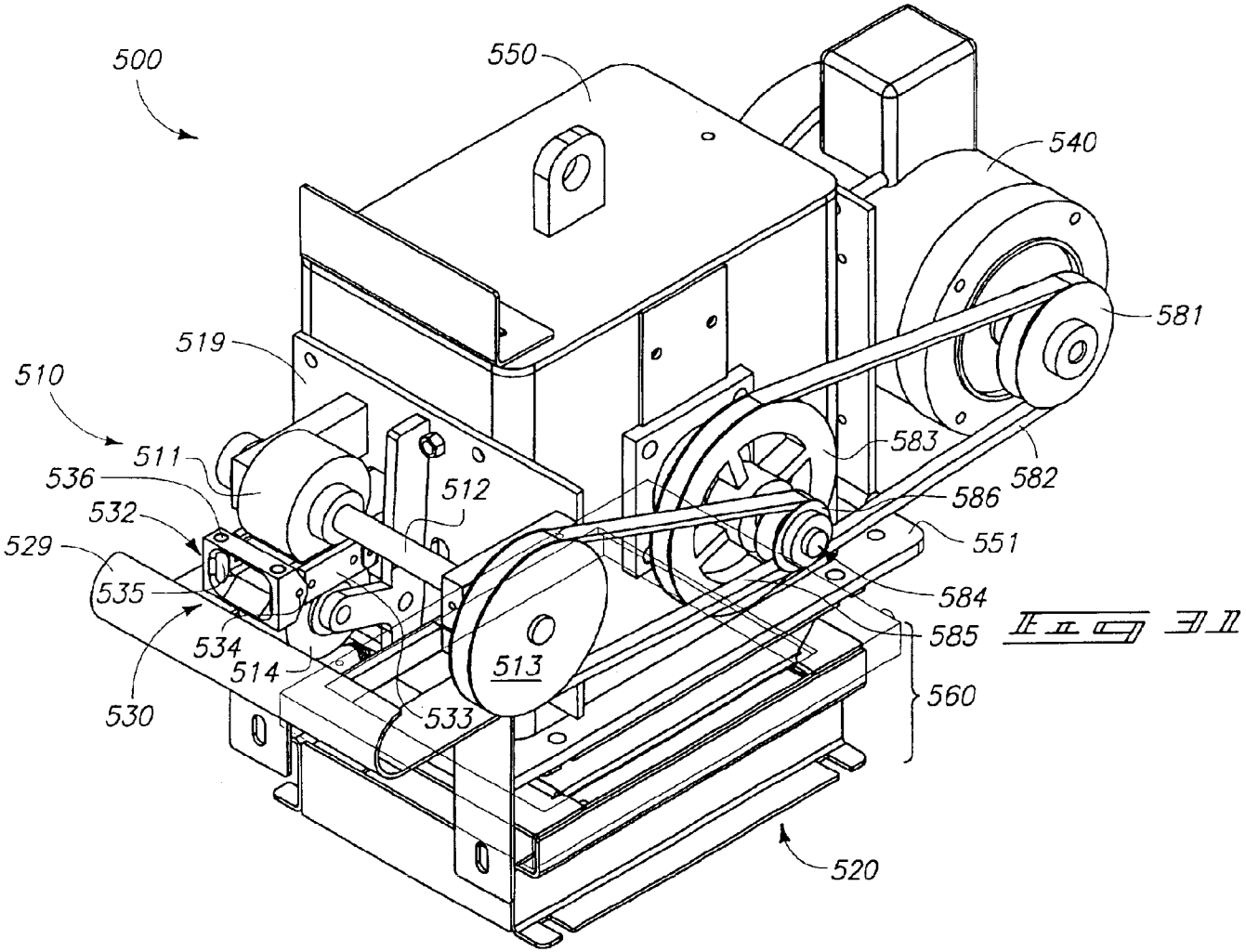
FIG. 31 is a perspective view showing the preferred chopping mechanism included as part of the debanding machine of FIG. 1 in isolation.
Figure 32:
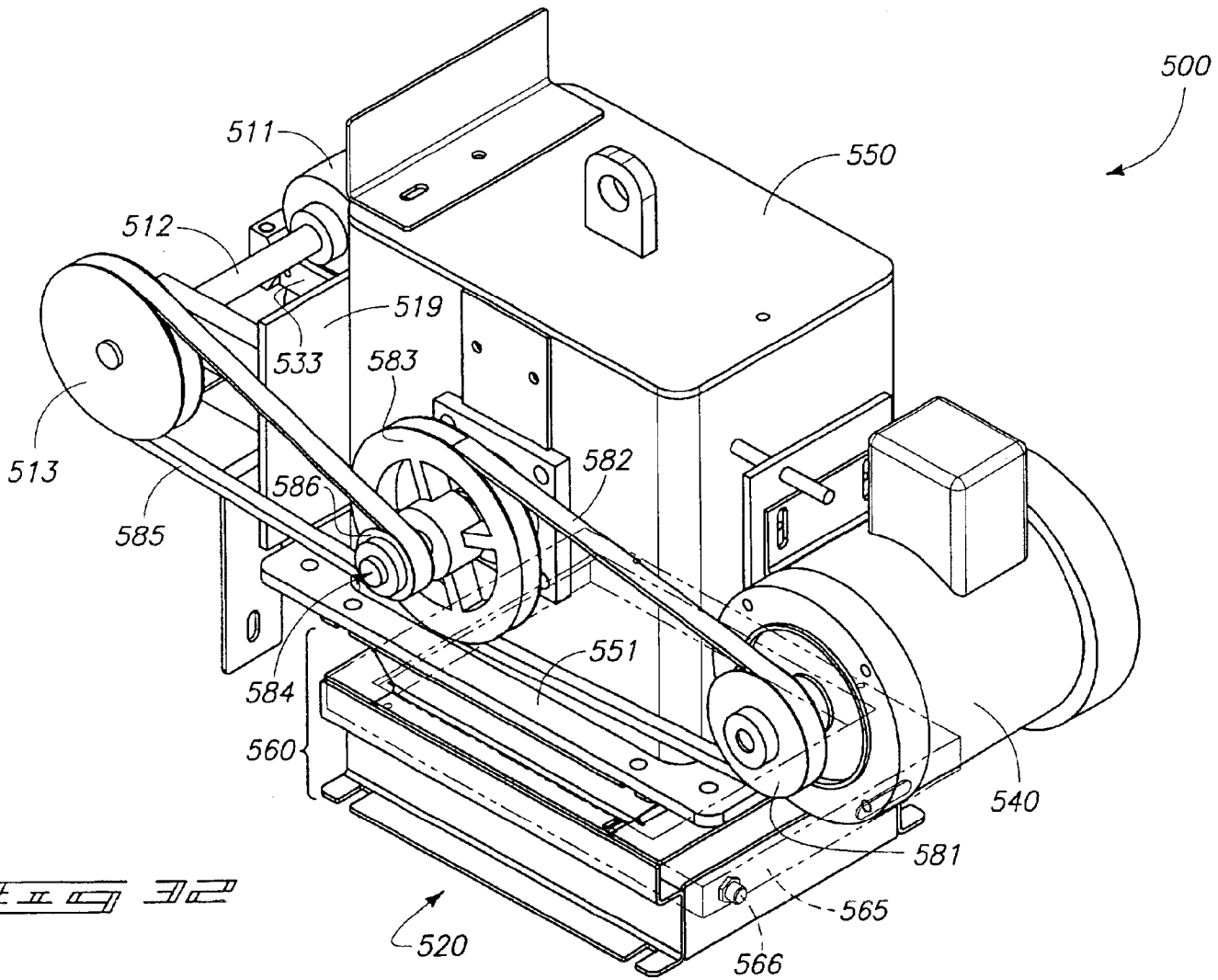
FIG. 32 is another perspective view showing the chopping mechanism subassembly of FIG. 31 viewed from an alternative angle.
Figure 31:
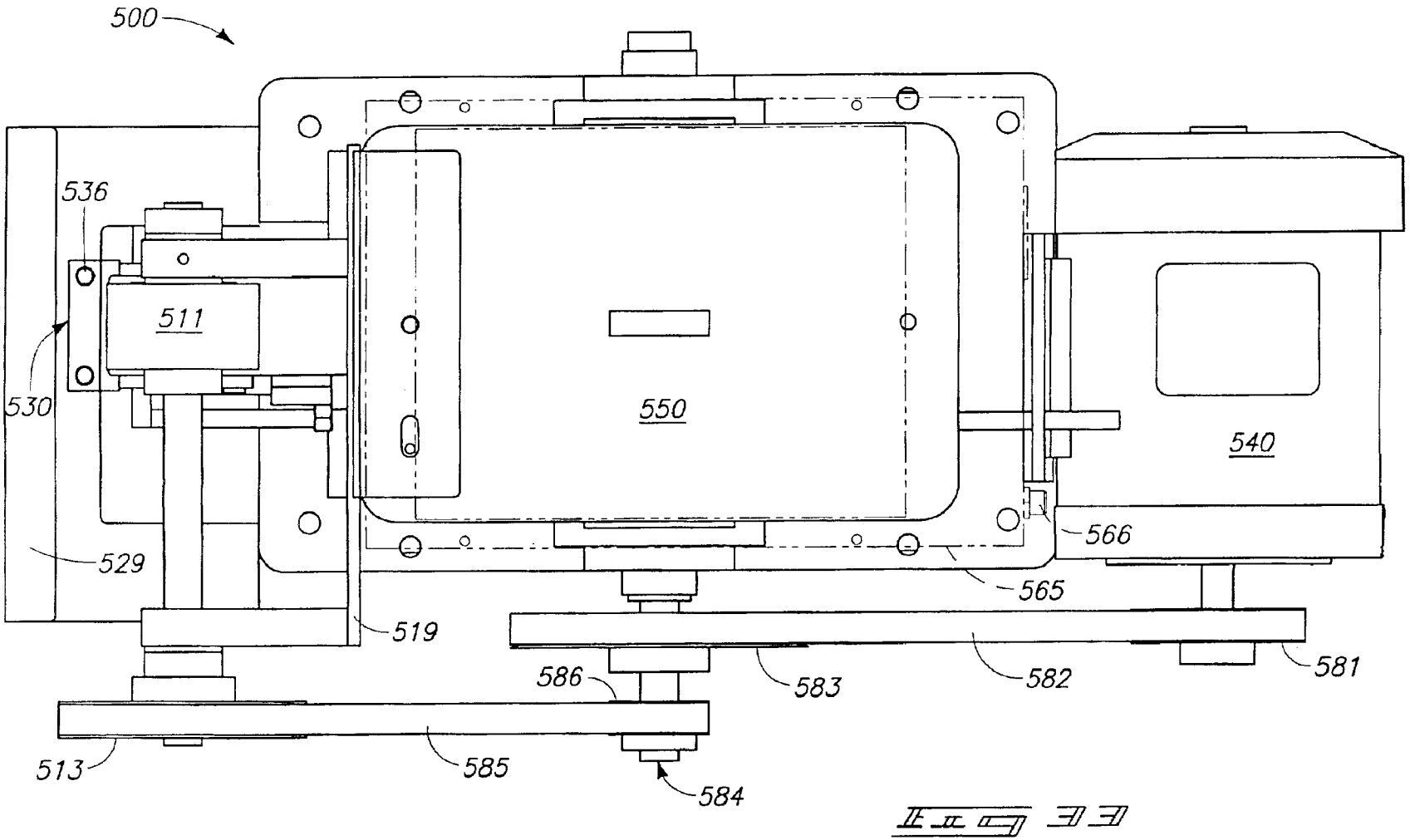
Figure 33:
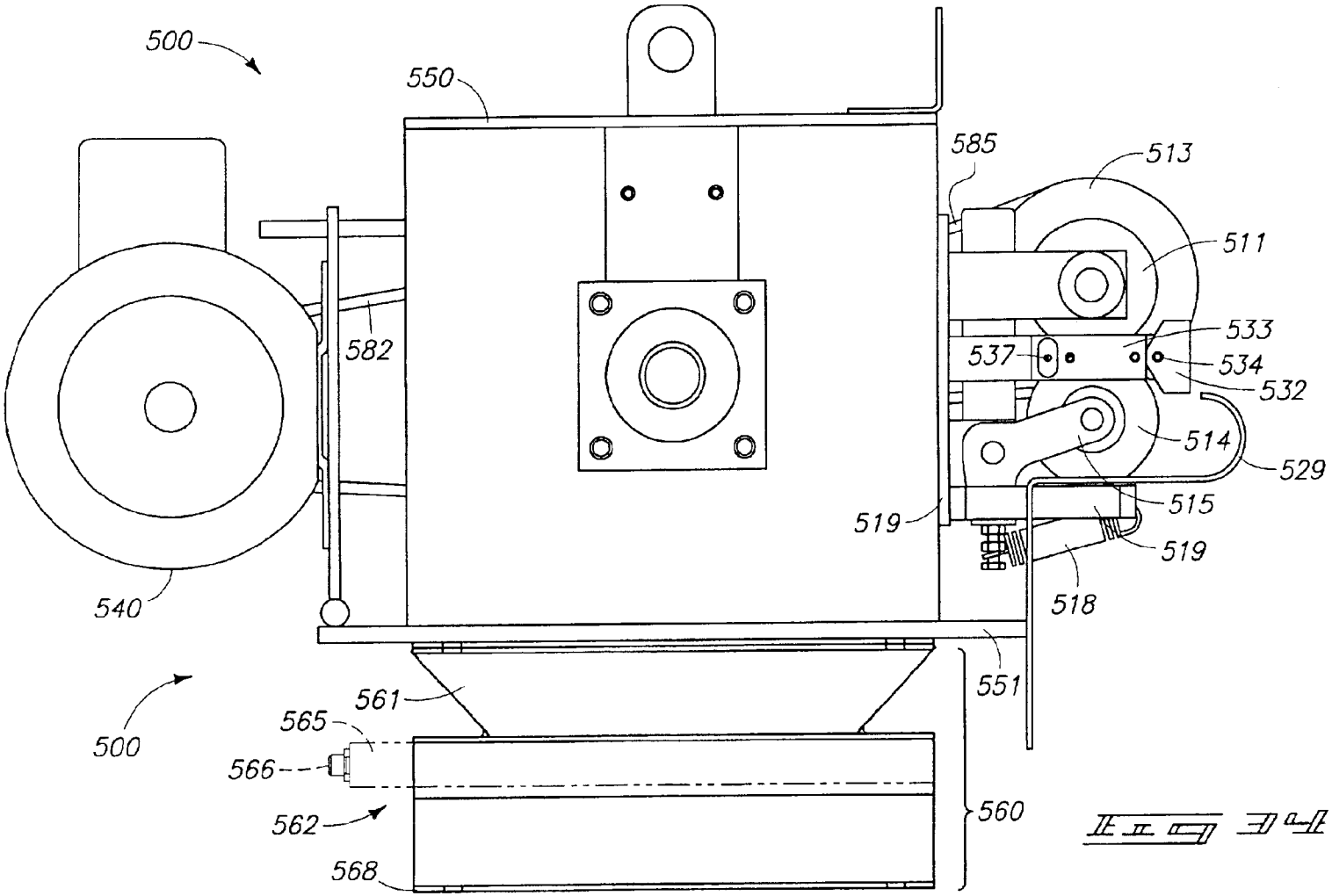
FIG. 33 is a top view of the subassembly of FIG. 31.
Figure 45:
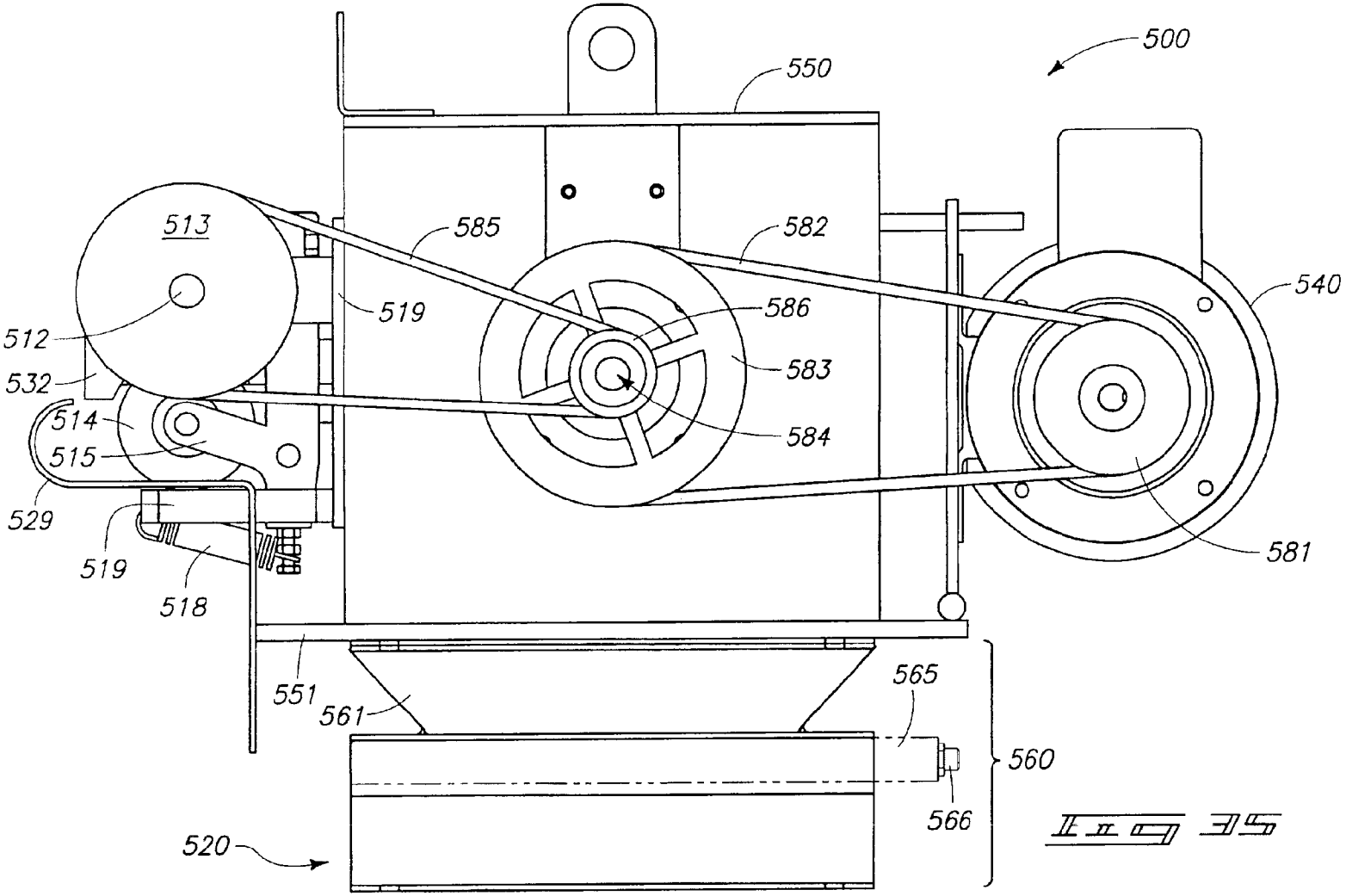
Figure 36:
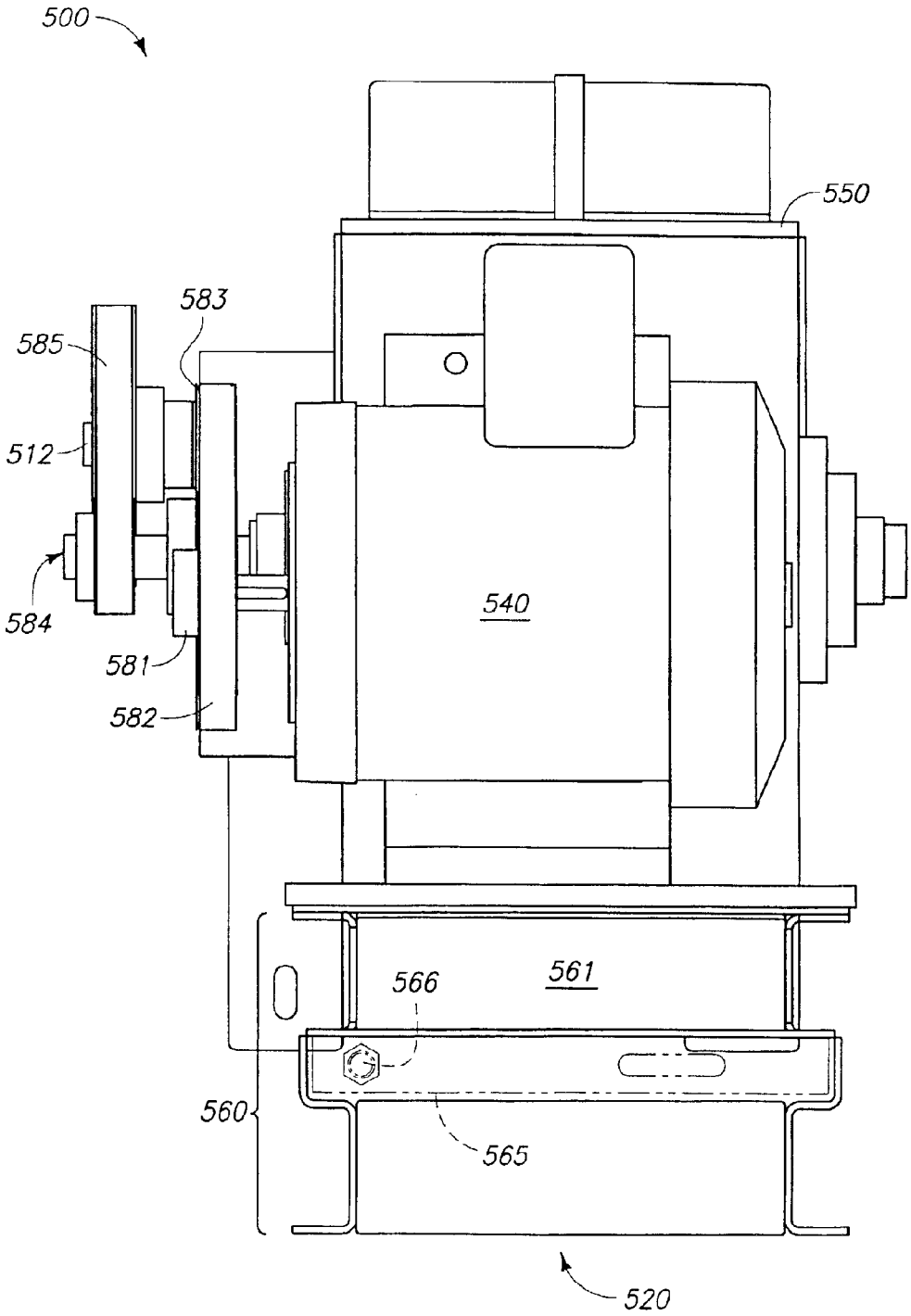
FIG. 36 is an end view of the subassembly of FIG. 31.
Figure 31:
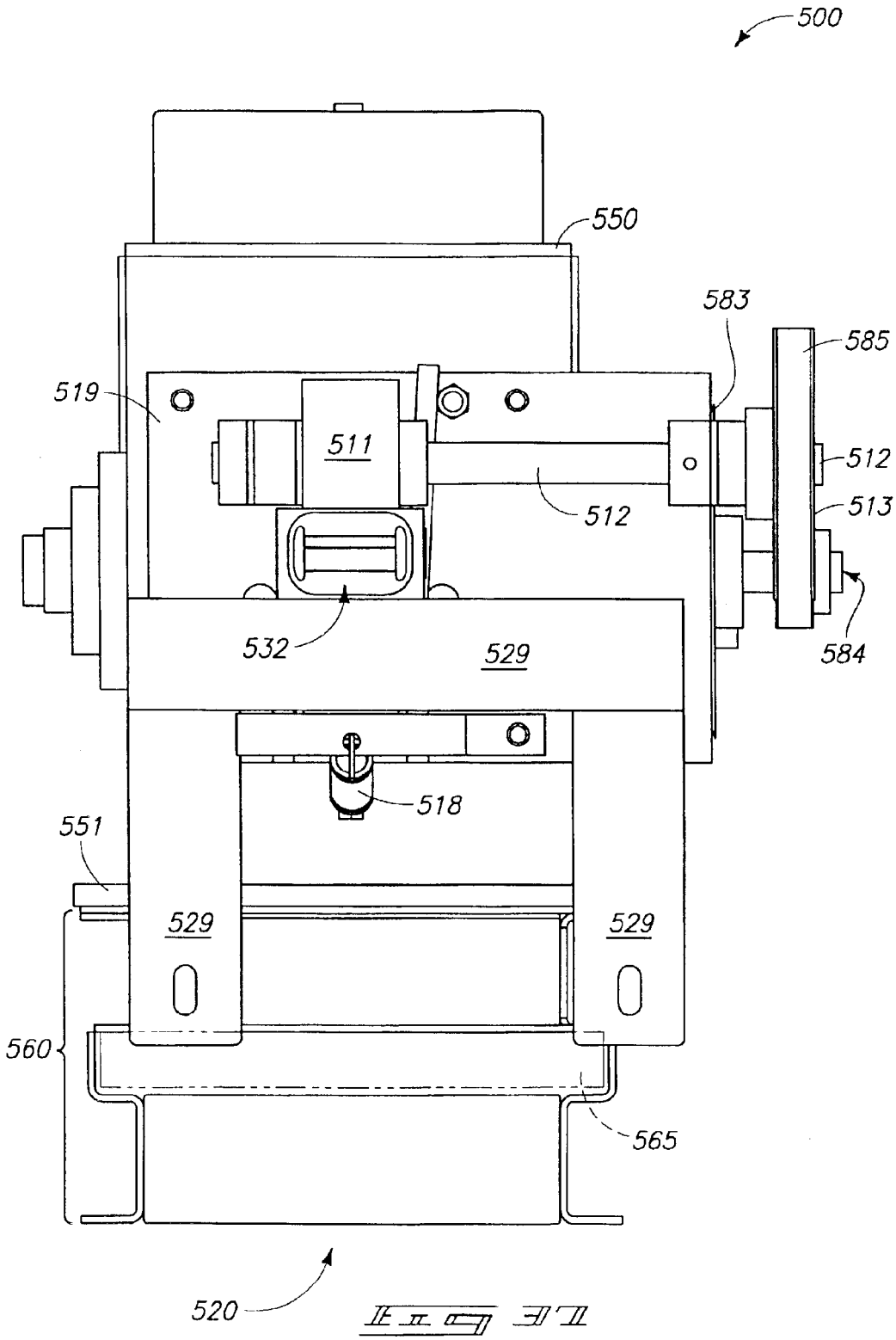

Refer to FIG. 31 which shows the band chopper assembly in isolation and greater detail. The band chopper has an infeed end 510 and a discharge 520 out the bottom of the unit. The end of a cut band is fed by the moving head 200 into a mouth assembly 530. Also see FIGS. 21 and 22 concerning the general movement of the head toward the chopper and their relative positions in preparing to feed a band into the chopper.

Chopper 500 also includes a motor 540 which is mounted on the opposite end from the infeed. Motor 540 drives several components including an internal cutter (not shown). The motor drives the internal cutter via a drive pulley 581, drive belt 582 and cutter sheave 583. Cutter sheave 583 is mounted upon a cutter rotor assembly 584. The internal cutter is mounted upon the rotor assembly.

Motor 540 is preferably adapted by providing a suitable braking is mechanism for slowing the motor to prevent long wind-down times which may present safety problems to mechanics working on the debanding machine. A preferred form of motor braking is provided in the form of a variable frequency electronic motor control which is configured to apply electric field braking when electrical power supplied to the motor is ended. This effectively applies a magnetic field or fields that attempt to slow the motor.

Motor 540 also drives an infeed wheel which is used to engage an incoming band being chopped, comminuted or otherwise divided into pieces. The infeed wheel is mounted on an infeed wheel shaft which has a sheave 513 attached thereto. Sheave 513 is driven by a belt 585 which is also trained about a sheave mounted to the rotating assembly 534.

The chopper infeed section 510 also includes a pressure wheel 514 which is mounted for frictional engagement against the infeed roller 511. Pressure wheel 514 is biased against the driven infeed roller 511 to thus apply force to a band being fed into mouth 530 and between rollers 511 and 514.

FIG. 34 indicates that the pressure wheel is preferably mounted for rotation at the end of a pivotal mounting arm 515 which has a pivot shaft 516 supported relative to the infeed mounting frame 519. Biasing force is applied through the mounting arm using a pressure roll biasing spring 518 connected to the arm and the infeed mounting frame 519. The biasing force provides drive friction between the infeed roller, pressure wheel and a pallet band being fed between them. This allows a band to be fed at a relatively fast rate so that the head assembly 200 does not delay longer than needed at the chopper station with each band being fed thereinto.

FIG. 31 shows that the chopper infeed also includes a mouthpiece 532. A guide 529 is used to assist in guiding incoming pallet bands into the mouthpiece. The mouthpiece is mounted to a rectangular feed tube 533 using mounting fasteners 534. Mouthpiece 532 has replaceable guides 535 which are pressed into apertures 536. Guides 535 act to guide the edges of bands being fed. They also act as replaceable wear parts that are preferably made of a wear resistant material, such as a suitable wear-resistant, hardened steel pin.

The feed tube 533 is advantageously provided with compressed air fittings 537 at both sides of the tube. These fittings extend into the interior feed channel defined by the feed tube. The fittings have nozzles or opening interior to the feed channel to jet air into and down the throat of the feed tube and associated feed passage in the chopper to help prevent clogging of the feed tube.

The central section 550 and many other parts of chopper 500 are commercially available from a suitable supplier, such as Sweed Machine of Gold Hill, Oreg.; Model 400 Quad. This construction has been found useful with the above modifications and others as will now be described.

The baseplate 551 of the central cutter section 550 is provided with a discharge assembly 560. FIG. 34 shows that the discharge assembly 560 is provided with a funnel section 561 which attaches to the discharge opening within the baseplate 551.

Funnel section 561 has a piece detector mount 562 connected at the lower, discharge side of the funnel. Mount 562 receives and supports a detector 565 used to sense passage of flying pieces of pallet band which have been expelled by the cutter turning within central cutter section 550. The pieces fall though an opening formed within the detector and interrupt multiple beams of light, infrared radiation or other detectable beams that are beamed across the detector's central opening to suitable photodiodes or other detectors positioned on the opposite side of the discharge passed within the detector. A suitable detection is a Model XUVF250M12 Telemecanique available from Schneider Electric, Palatine, Ill. The output from the detector is communicated via an electrical detector output signal coupling 566 which is connected to the control system. The signals from detector 565 provide confirmation that the chopper is properly discharging pieces. If the detector fails to detect band pieces then the discharge chute 501 may be plugged, the chopper cutter may be inoperable, or the band may be stuck on the pallet.

The discharge section 560 also includes a lower flange 568 which interfaces with the discharge chute 501. Outgoing or discharging band pieces pass therethrough.

Control System

Figure 38B:
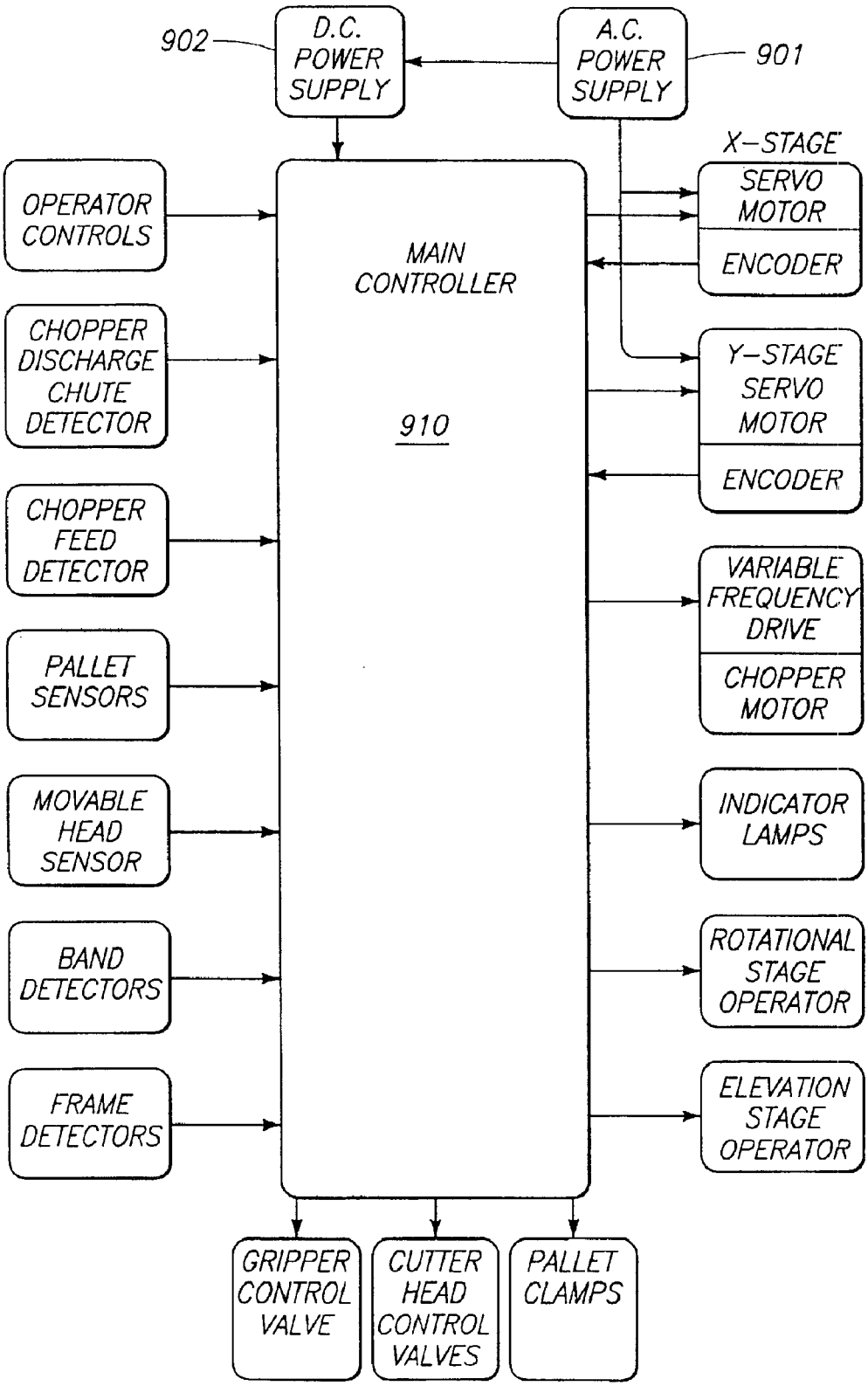
FIG. 38 is a schematic block diagram of the controller and relationship to key components.

FIG. 38 shows in block diagram schematic form the configuration for the control system 900 advantageously used in debanding machine 10. The control system includes an alternating current (A.C.) power supply 901. Supply 901 may be a three-phase nominal 230 volt 60 Hz supply from an electrical supply system mains.

Alternating current from supply 901 is in part fed to a direct current (D.C.) power supply 902 used to provide a suitable D.C. voltage such as 24 volts. The electrical current from supply 902 is used to power a main controller 910 which may be a suitable programmable logic array or other system controller capable of programming to perform the functions indicated herein.

The system also includes a number of operator controls, such as from panel 121 or otherwise which are connected to the main controller to coordinate and sequence operations. Exemplary sensors are also shown and are connected to the main controller to provide information relevant to the conduct of the control process.

Also shown are the X-stage and Y-stage servo motors which have associated positional encoders which are detecting position information of the movable head and sending such information to the main controller for processing with the control programming. The chopper motor variable frequency drive is controlled to provide operation of the chopper during periods when bands are being comminuted.

Main controller 910 is also connected to indicator lamps that show various operations being performed by the debanding machine.

The main controller also directs operations of the various components described above, and in particular are pictured in FIG. 38 the action of the gripper, cutter head, cutter and pallet clamps that are operated using electrically activated solenoid valves controlling supply of compressed air to the various pneumatic controls.

Further Description of Operation

Figure 39:
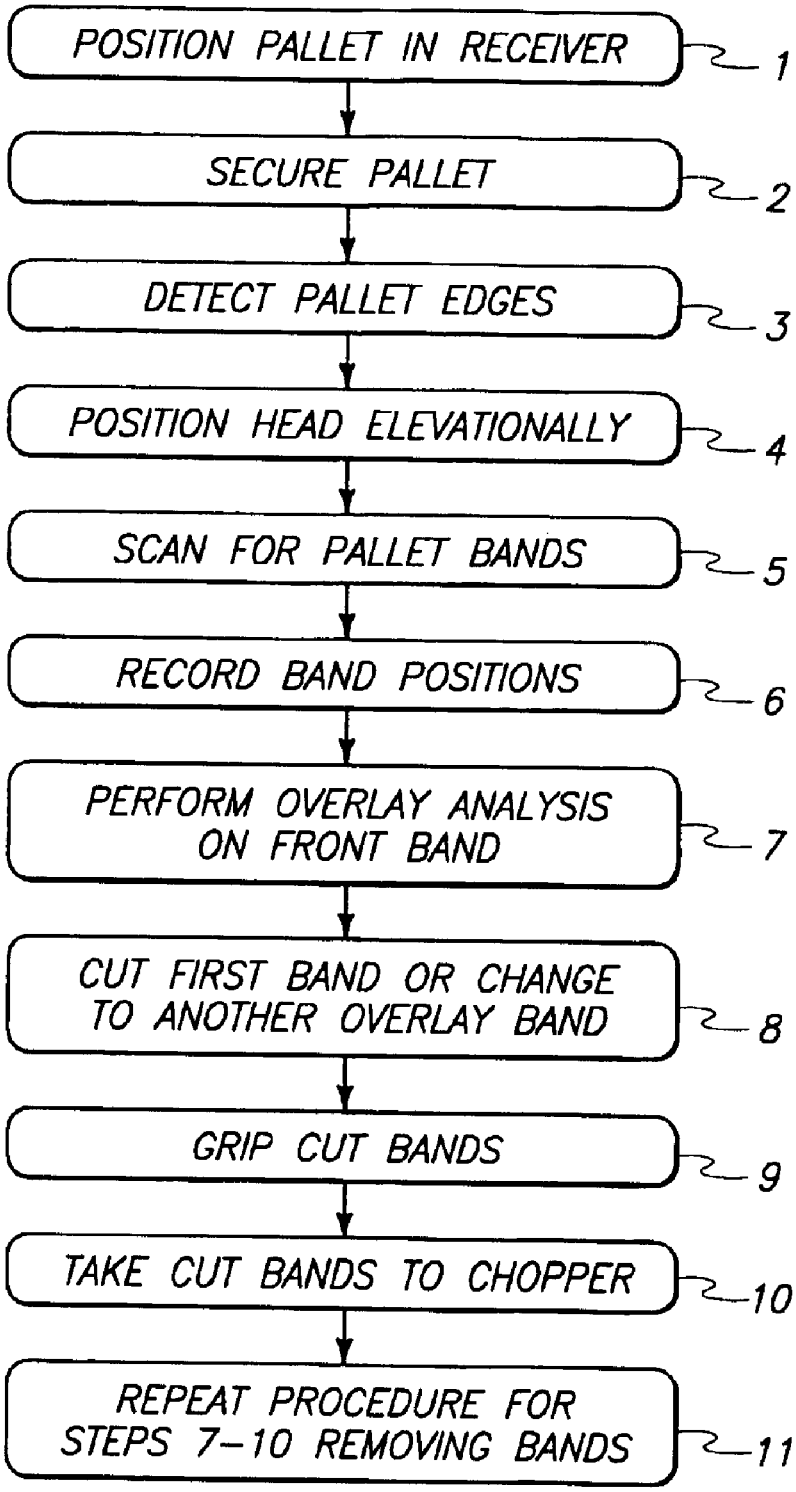
FIG. 39 is a process flow diagram.

In the above description a number of operational aspects have been described. Additional operational aspects are explained below. FIG. 39 shows notable steps in the procedure more fully described above.

A pallet is moved into the receiver using the conveyor 20. The position of the pallet is detected by suitable pallet position detectors, such as a beaming photodetector that is activated when the beam is broken by the pallet arriving at a suitable position. Once positioned, the pallet is secured by deploying the pallet clamps.

After the pallet has been properly positioned and secured in the working position within the receiver, then the movable head is positioned by the head drive mechanism to detect the edge position of the pallet. This is preferably done by detecting the X-stage position first and then the Y-stage edge position is detected after moving the head with edge detector thereon. In most applications it is only necessary to detect one X-stage edge position and one Y-stage edge position. Alternatively, it is possible to detect the edge positions of all four top edges if desired.

In the preferred methods the head is then moved to a suitable position to determine the height of the pallet being worked upon. This is typically done along the edge of the pallet. In greater particularity, the head may be moved to a position along the front of the machine near the chopper and then lowered by releasing air pressure from primary actuator 360 allowing it to drop under the force of gravity. The head comes to rest with the contact bumper 730 against the top of the pallet. The height information is not recorded by the controller but it could be. Instead, it has been found preferable to utilize the clamping mechanism explained above to clamp rod 492 and thus record the general pallet height. This height parameter is then used to generally establish the height range for subsequent operations. After the general height has been determined, the secondary actuator is operated to achieve desired height changes during operations on a specific pallet. Each pallet is assessed with regard to its height using this configuration.

The band detector is then used to locate the position and number of the bands present on the pallet. This is advantageously done by scanning the head over the pallet and detecting each band using the band detectors as explained above. As the bands are detected the position of the head is recorded using the servo motor encoder information associated with a band detection position. This is stored in the controller memory for future use in controlling machine operation.

It has been found preferable in some situations to have the moving head 200 operated in the band detection phase in two or more scanning speeds. This is done by having anticipated band locations and then moving more rapidly toward the anticipated band locations. Upon reaching a zone in proximity to the anticipated band location, the motors are controlled to move at a slower speed to improve the scanning detection capabilities of the machine.

The above scanning band detection modes of operation are 0.19 performed for both the X and Y directions. In some preferred forms of the invention the Y-axis bands are scanned for first, followed by scanning the head to detect X-axis bands. The resulting information indicating the number and position of the bands is recorded in the controller.

After the band scan of the pallet has been completed, then the head is raised to the up position by releasing the clamp mechanism and using the primary actuator. The head is then moved to the desired edge position near the first band cut location desired. In this position, the head is once again lowered to establish the pallet height. The clamping mechanism is clamped into engagement to establish the general working height. The secondary operator then is used for further height variations. At this point the head may be raised slightly to clear the pallet frame or other top surface.

The head positioning mechanisms then move the head to the desired first cut position which is a function of the detected number and positions of the bands. In general the first band approached for cutting will be along one edge of the pallet and the bands are if possible pursued with the head in the same orientation.

Concomitant with the approach to the first band the debander performs a procedure which performs the function of an overlay analyzer which determines whether the first band planned to be cut is an overlay band or an underlay band. If the first band intended to be cut is an overlay band, then the cutting operation proceeds. If the first band to be cut is an underlay band, then the control system adjusts the intended band and cuts the other intersecting band which is in actuality an overlay band. The machine needs to cut the overlay band first to prevent possible entanglement of the cut band as it is removed from the pallet.

Overlay Analyzer

The debanding machine preferably conducts a procedure and has structural features that act as a overlay analyzer. This is performed by engaging the head assembly 200 with the proposed band to be cut. The head assembly includes an overlay foot or contact 788 (FIG. 30) that bears upon the band running the same direction as the cutter is oriented and moving. Foot 788 runs along the band until it reaches a band crossing. If the proposed band to be cut (which is crosswise to the band along which the foot is running) is an overlay band, then the band guides 740 and 726 will engage and receive the band and the band will be detected by the band engagement detector 770. If the band being approached is an underlay band, then the contact foot 788 continues along that band and the band guides 726 and 740 will not go into engagement with the crossing band being approached for cutting. The crossing band avoids guides 726 and 740 and will not be detected by band engagement detector 770. This acts to discriminate the approached band as overlay or underlay.

The controller is programmed that travel beyond a specified distance, such as 0.25 to 1 inch beyond the previously determined band position is indicative that the band refused to be taken up by the band guides 726 and 740 and thus the approached band was an underlay band.

The controller is also programmed to then proceed by turning the rotating stage to the other orientation and to cut another band. The process of gripping and cutting the bands thus proceeds as described below.

Gripping, Cutting, Relocation and Chopping Operations

If the approached band is properly engaged, then the band engagement detector sensed the band and this is used as a condition in the control programming to then grip the band using the band gripper. The band gripper actuator is activated to close the gripper jaws and the band is engaged. The Cutting operation is then initiated by activating the cutter actuator causing the cutter jaws to cut the band thus severing the band at the cutting location.

Figure 22:
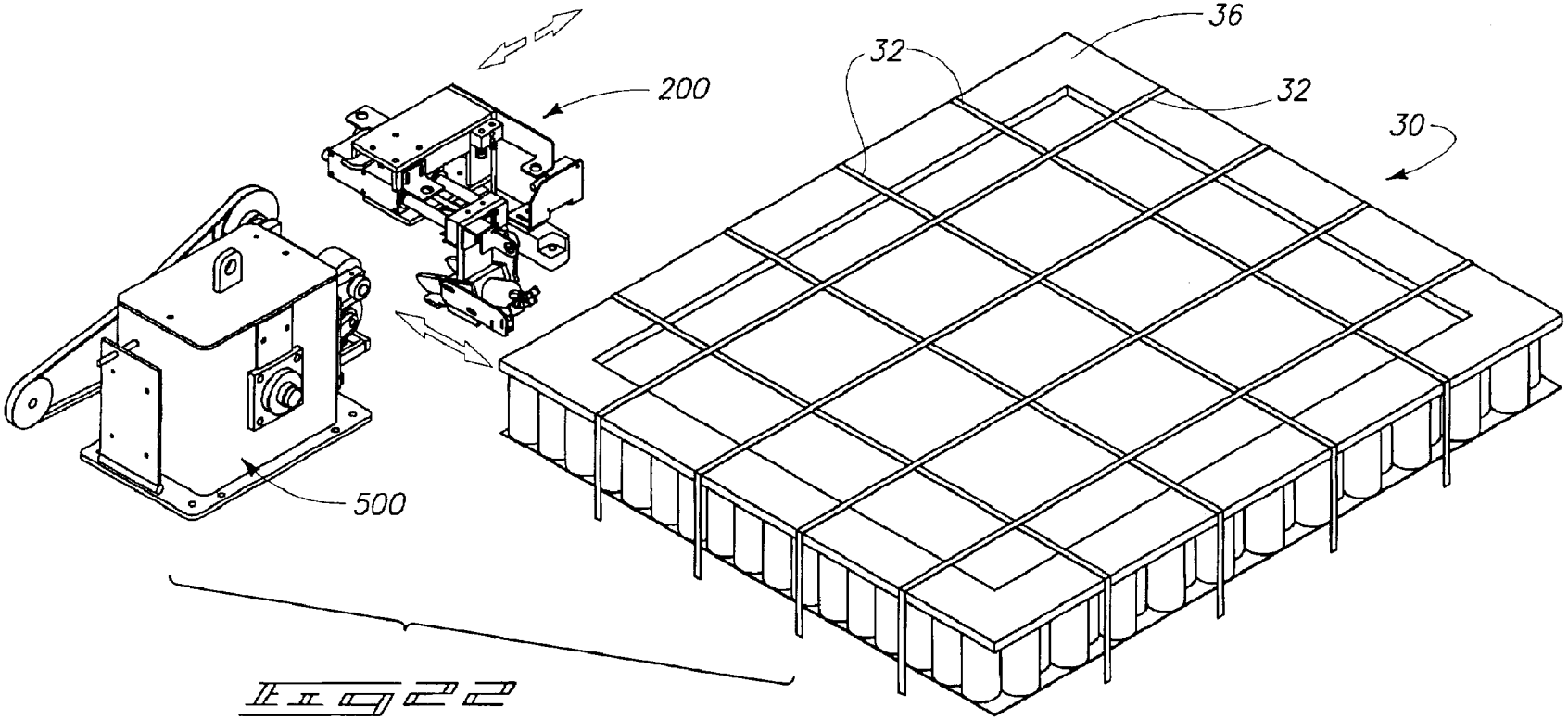
FIG. 22 is similar to FIG. 21 with the movable head portions illustrated repositioned, such as to insert a cut band into the band chopper.

Once the band is cut, the gripper has hold of the band and the controller directs the movable head assembly to move to the chopper station. The gripped band is held and pulled toward the chopper. The cutter assembly is retracted to provide a free end of the band as indicated in FIGS. 22 and 24. The free end of the cut band is then inserted into the chopper mouth and the chopper is operated to cut the band into pieces as the band is pulled. The gripper is released to allow the band to feed into the chopper.

Pallet Learning Storage for Subsequent Use

Another aspect of the debanding machine is the ability to store or record the pallet band pattern information and use it on subsequent pallets. The band information from a first pallet may be used to either speed operations by providing expected band position information to a subsequent band scanning operation, or can be used directly as the band position information for a subsequent pallet of similar configuration. The band pattern information is kept in the controller memory and then recalled as if the scan information had been taken anew for the second pallet being operated upon.

Interpretation Note

The invention has been described in language directed to the current embodiments shown and described with regard to various structural and methodological features. The scope of protection as defined by the claims is not intended to be necessarily limited to the specific features shown and described because other forms and equivalents for implementing the invention can be made and in some cases this is done simple to evade the intended purpose of this document and any exclusive rights associated therewith.

We claim:

1. An apparatus for automated debanding of pallets by cutting bands which extend about at least portions of the pallet being operated upon, comprising:

a frame;

at least one receiver at which a pallet is received to be operated upon by the apparatus;

at least one movable head mounted upon said frame for movement relative to a pallet received in said at least one receiver;

at least one band detector which scans at least one surface of a pallet to detect the number and location of bands which are on a pallet being operated upon in the at least one receiver by said apparatus;

at least one band cutter mounted upon the at least one movable head for severing bands extending about a pallet positioned in the at least one receiver;

at least one controller for recording information obtained from the at least one band detector indicating the number and position of any bands on a pallet being operated upon; and an overlay analyzer for determining which of any intersecting bands on a pallet being operated upon are overlay bands and for causing an overlay band of any such intersecting bands to be cut before any cutting of an underlay band of the intersecting bands.

2. An apparatus according to claim 1 wherein said overlay analyzer uses movement of the at least one movable head over a pallet band to determine the overlay pattern of the pallet.

3. An apparatus according to claim 1 wherein said overlay analyzer uses movement of the at least one movable head over a pallet band, intersection as part of the information used to determine the overlay pattern of the pallet.

4. An apparatus according to claim 1 wherein said at least one controller records band pattern information for later use in considering other pallets.

5. An apparatus according to claim 1 and further comprising at least one frame detector for detecting the position of a top frame used on a pallet.

6. An apparatus according to claim 1 wherein the at least one band detector is mounted upon the at least one movable head and moves therewith.

7. An apparatus according to claim 1 wherein the receiver is in the form of a receiver bay over which the at least one movable head moves.

8. An apparatus according to claim 1 and further comprising at least one gripper for gripping an end of a band being severed by said at least one band cutter.

9. An apparatus according to claim 1 and further comprising at least one band chopper which receives severed bands and for piecing bands into pieces.

10. An apparatus for automated debanding of pallets by cutting bands which extend about at least portions of the pallet being operated upon, comprising:

a frame;

at least one receiver at which a pallet is received to be operated upon by the apparatus;

at least one movable head mounted upon said frame for movement relative to a pallet received in said at least one receiver;

at least one band detector mounted upon said at least one movable head which scans with movement thereof at least one surface of a pallet to detect the number and location of bands which are on a pallet being operated upon in the at least one receiver by said apparatus;

at least one band cutter mounted upon the at least one movable head for severing bands extending about a pallet positioned in the at least one receiver;

at least one band gripper mounted upon the at least one movable head for holding bands that are severed by the at least one band cutter;

at least one controller for recording information obtained from the at least one band detector indicating the number and position of any bands on a pallet being operated upon; and an overlay analyzer for determining which of any intersecting bands on a pallet being operated upon are overlay bands and for causing an overlay band of any such intersecting bands to be cut before any cutting of an underlay band of the intersecting bands.

11. An apparatus according to claim 10 wherein said overlay analyzer uses movement of the at least one movable head over a pallet band to determine the overlay bands.

12. An apparatus according to claim 10 wherein said overlay analyzer uses movement of the at least one movable head over a pallet band intersection as part of the information used to determine the overlay bands.

13. An apparatus according to claim 10 wherein said at least one controller records band pattern information for later use in considering other pallets.

14. An apparatus according to claim 10 and further comprising at least one frame detector for detecting the position of a top frame used on a pallet.

15. An apparatus according to claim 10 and further comprising at least one band chopper which receives severed bands and for piecing bands into pieces.

16. An apparatus for automated debanding of pallets by cutting bands which extend about at least portions of the pallet being operated upon, comprising:

a frame;

at least one receiver at which a pallet is received to be operated upon by the apparatus;

at least one movable head mounted upon said frame for movement relative to a pallet received in said at least one receiver;

at least one band detector which scans at least one surface of a pallet to detect the number and location of bands which are on a pallet being operated upon in the at least one receiver by said apparatus;

at least one band cutter mounted upon the at least one movable head for severing bands extending about a pallet positioned in the at least one receiver;

at least one controller for controlling operation of the apparatus; and an overlay analyzer for determining which of any intersecting bands on a pallet being operated upon are overlay bands and for causing an overlay band of any such intersecting bands to be cut before any cutting of an underlay band of the intersecting bands.

17. An apparatus according to claim 16 wherein said overlay analyzer uses movement of the at least one movable head over a pallet band to determine the overlay bands.

18. An apparatus according to claim 16 wherein said overlay analyzer uses movement of the at least one movable head over a pallet band intersection as part of the information used to determine the overlay bands.

19. An apparatus according to claim 16 and further comprising at least one frame detector for detecting the position of a top frame used on a pallet.

20. An apparatus according to claim 16 wherein the at least one band detector is mounted upon the at least one movable head and moves therewith.

21. An apparatus according to claim 16 wherein the receiver is in the form of a receiver bay over which the at least one movable head moves.

22. An apparatus according to claim 16 and further comprising at least one gripper for gripping an end of a band being severed by said at least one band cutter.

23. An apparatus according to claim 16 and further comprising at least one band chopper which receives severed bands and for piecing bands into pieces.

24. A method for automated debanding of pellets by cutting bands which extend about at least portions of the pallet being operated upon, comprising:

scanning at least one surface of the pallet to determine bands present on a pallet being operated upon;

analyzing the bands to determine which band is an overlay band of any intersecting bands on the pallet;

using a power operated, controllably movable head having a cutter thereon to perform band cutting;

cutting the overlay band of any intersecting bands;

removing any cut overlay bands;

cutting the underlay band remaining at any band intersection after the overlay band has been cut; and removing any cut underlay bands.

25. A method according to claim 24 wherein the scanning is performed by moving an optical detector over the surface of the pallet.

26. A method according to claim 24 and further comprising detecting the size of any pallet frame positioned on top of the pallet.

27. A method according to claim 24 and further comprising contacting and moving a movable head over the bands near a band intersection to help in said analyzing step.

28. A method according to claim 24 and further comprising using information obtained in said scanning step for operations upon another pallet.

29. A method according to claim 24 and further comprising using information obtained in said scanning and analyzing steps for operations upon another pallet.

30. A method according to claim 24 and further comprising using information obtained in said analyzing step for operations upon another pallet.

31. A method according to claim 24 and further comprising sensing the height of the pallet.

32. A method according to claim 24 and further comprising sensing the height of the pallet by contacting the pallet with a movable head.

33. A method according to claim 24 and further comprising performing a final scan of the pallet to assure that all bands have been removed.

34. A method according to claim 24 and further comprising:

performing a final scan of the pallet to assure that all bands have been removed; and cutting any remaining bands found in said performing step.

35. A method according to claim 24 and further comprising chopping bands removed is said removing steps.

36. A method for automated debanding of pallets by cutting bands which extend about at least portions of the pallet being operated upon, comprising:

scanning at least one surface of the pallet to determine the position and number of bands present on a pallet being operated upon;

recording information indicating the position and number of bands present on a pallet being operated upon;

analyzing the bands to determine which band is an overlay band of any intersecting bands on the pallet;

cutting the overlay band of any intersecting bands running crosswise to the cutting direction;

removing any cut overlay band;

cutting the underlay band remaining at any band intersection after the overlay band has been cut; and removing any cut underlay bands.

37. A method according to claim 36 wherein the scanning is performed by moving an optical detector over the surface of the pallet.

38. A method according to claim 36 and further comprising detecting the size of any pallet frame positioned on top of the pallet.

39. A method according to claim 36 and further comprising contacting and moving a movable head over the bands near a band intersection to help in said analyzing step.

40. A method according to claim 36 and further comprising using information obtained in said scanning step for operations upon another pallet.

41. A method according to claim 36 and further comprising using information obtained in said scanning and analyzing steps for operations upon another pallet.

42. A method according to claim 36 and further comprising using information obtained in said analyzing step for operations upon another pallet.

43. A method according to claim 36 and further comprising sensing the height of the pallet.

44. A method according to claim 36 and further comprising sensing the height of the pallet by contacting the pallet with a movable head.

45. A method according to claim 36 and further comprising performing a final scan of the pallet to assure that all bands have been removed.

46. A method according to claim 36 and further comprising:

performing a final scan of the pallet to assure that all bands have been removed; and cutting any remaining bands found in said performing step.

47. A method according to claim 36 and further comprising chopping bands removed is said removing steps.

* * * * *